US011557251B2

(12) United States Patent
Okabe et al.

(10) Patent No.: US 11,557,251 B2
(45) Date of Patent: Jan. 17, 2023

(54) DISPLAY DEVICE AND DRIVE METHOD THEREFOR

(71) Applicant: SHARP KABUSHIKI KAISHA, Sakai (JP)

(72) Inventors: Tohru Okabe, Sakai (JP); Takeshi Yaneda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/280,124

(22) PCT Filed: Sep. 28, 2018

(86) PCT No.: PCT/JP2018/036597
§ 371 (c)(1),
(2) Date: Mar. 25, 2021

(87) PCT Pub. No.: WO2020/066024
PCT Pub. Date: Apr. 2, 2020

(65) Prior Publication Data

US 2021/0343238 A1 Nov. 4, 2021

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC .. G09G 3/3233; G09G 3/3266; G09G 3/3275; G09G 2300/043;
(Continued)

(56) References Cited

U.S. PATENT DOCUMENTS

2004/0036669 A1* 2/2004 Yanagi ..... G09G 5/18 345/98
2007/0052647 A1* 3/2007 Chen ..... G09G 3/3233 345/92

(Continued)

FOREIGN PATENT DOCUMENTS

JP 2004-078124 A 3/2004
JP 2013-003569 A 1/2013
JP 2017-083813 A 5/2017

*Primary Examiner* — David Tung
(74) *Attorney, Agent, or Firm* — ScienBiziP, P.C.

(57) ABSTRACT

The present application discloses a current-driven display device capable of providing satisfactory display without flickering even when pause drive is performed. In a pixel circuit 15, a first initialization transistor T4 initializes a gate voltage Vg, and thereafter a voltage on a data signal line Di is written to a holding capacitor Cst via a write control transistor T2 and a drive transistor T1. Thereafter, emission control transistors T5 and T6 are turned on, so that a drive current I1 from the drive transistor T1 causes an organic EL element OL to emit light. During this emission period, even if the gate voltage Vg is decreased due to a leakage current through the first initialization transistor T4 in an OFF state, the decrease is compensated for by increasing a threshold control voltage being provided to a threshold control terminal TG of the drive transistor T1. Thus, even if the pause drive results in a long refresh cycle, it is possible to inhibit an increase in luminance due to the decrease in the gate voltage Vg and thereby prevent the occurrence of flickering.

14 Claims, 9 Drawing Sheets

(52) U.S. Cl.
CPC ..... *G09G 2300/043* (2013.01); *G09G 2300/0819* (2013.01); *G09G 2300/0842* (2013.01); *G09G 2310/0213* (2013.01); *G09G 2320/0247* (2013.01); *G09G 2320/10* (2013.01); *G09G 2330/021* (2013.01)

(58) Field of Classification Search
CPC ... G09G 2300/0819; G09G 2300/0842; G09G 2300/0852; G09G 2310/0213; G09G 2310/061; G09G 2320/0247; G09G 2320/10; G09G 2330/021
See application file for complete search history.

(56) References Cited

U.S. PATENT DOCUMENTS

| | | | | |
|---|---|---|---|---|
| 2012/0327058 | A1* | 12/2012 | Minami | G09G 3/3208 345/55 |
| 2013/0119412 | A1* | 5/2013 | Kasai | H01L 27/3262 257/E33.053 |
| 2015/0371606 | A1* | 12/2015 | Lee | G09G 3/3233 345/82 |
| 2016/0042694 | A1* | 2/2016 | Lim | G09G 3/3233 345/78 |
| 2016/0104424 | A1* | 4/2016 | Lim | G09G 3/3258 345/76 |
| 2016/0124491 | A1* | 5/2016 | An | G06F 1/3265 713/323 |
| 2017/0124958 | A1 | 5/2017 | Pyo et al. | |
| 2019/0051245 | A1* | 2/2019 | Jun | H01L 29/78615 |
| 2019/0096330 | A1* | 3/2019 | Kim | G09G 3/3233 |

* cited by examiner

DISPLAY DEVICE AND DRIVE METHOD THEREFOR

TECHNICAL FIELD

The disclosure relates to display devices, more specifically to a current-driven display device, such as an organic EL (electro-luminescent) display device, which is provided with display elements to be driven by currents, and also relates to a method for driving the same.

BACKGROUND ART

In recent years, organic EL display devices provided with pixel circuits which include organic EL elements (also referred to as organic light-emitting diodes (OLEDs)) have been put into practical use. In addition to the organic EL elements, the pixel circuits in the organic EL display devices include drive transistors, write control transistors, holding capacitors, etc. As the drive transistors and the write control transistors, thin-film transistors are used, and the drive transistors are connected at gate terminals, which serve as control terminals, to the holding capacitors, to which drive circuits supply data voltages via data signal lines; the data voltages are voltages corresponding to video signals that represent images to be displayed (more specifically, voltages that specify gradation values for pixels to be formed by the pixel circuits). The organic EL elements are self-luminous display elements which emit light with intensities corresponding to currents flowing therethrough. The drive transistors are provided in series with the organic EL elements and configured to control the currents flowing through the organic EL elements in accordance with voltages being held by the holding capacitors.

On the other hand, there are known low-power display devices in which pause drive (also called intermittent drive or low-frequency drive) is performed. Pause drive is a drive method using a drive period (refresh period) and a pause period (non-refresh period) when the same image is continuously displayed, and the drive period and the pause period are set such that a drive circuit operates during the drive period but stops operating during the pause period. Pause drive can be applied when transistors in pixel circuits offer good off-state leakage characteristics (i.e., off-state leakage current is low). Such a display device which performs pause drive is described in, for example, Patent Document 1.

CITATION LIST

Patent Documents

Patent Document 1: JP 2004-78124 A
Patent Document 2: JP 2017-83813 A
Patent Document 3: JP 2013-3569 A

SUMMARY

Technical Problem

The organic EL elements and the drive transistors are susceptible to variations and shifts in characteristics. Accordingly, in order for the organic EL display devices to achieve high-quality image display, it is necessary to compensate for such variations and shifts in element characteristics. In an organic EL display device in which element characteristics are compensated for within pixel circuits for such a purpose, for example, the pixel circuits are configured such that voltages on gate terminals of drive transistors, i.e., voltages that are being held by holding capacitors, are initialized to a predetermined level, and thereafter the holding capacitors are charged with data voltages via drive transistors in diode connection. The pixel circuit thus configured is provided with an initialization transistor for initializing the voltage that is being held by the holding capacitor, which is connected at a terminal to an initialization voltage supply line via the initialization transistor (the terminal also being connected to the gate terminal of the drive transistor).

In the case of a display device provided with pixel circuits as described above, when pause drive as described earlier is performed, the luminance of the organic EL element is decreased or increased during the pause period and returns to the original value upon each start of the drive period. In pause drive, the pause period lasts much longer than a normal frame period (1/60 of a second), and essentially, when compared to in normal drive, the drive frequency of the display device is significantly reduced (e.g., to 10 Hz or less). Once the drive frequency is significantly reduced due to pause drive, as described above, the luminance of the organic EL element changes due to repetitive switching between the pause period and the drive period, and such luminance changes might be perceived as flickering.

Therefore, it is desired to enable a current-driven display device to provide satisfactory display without flickering even when pause drive is performed.

Solution to Problem

Several embodiments of the disclosure provide a display device having a plurality of data signal lines, a plurality of scanning signal lines crossing the data signal lines, and a plurality of pixel circuits arranged in a matrix along the data signal lines and the scanning signal lines, the device including:

first and second power supply lines;

a data signal line drive circuit configured to drive the data signal lines;

a scanning signal line drive circuit configured to selectively drive the scanning signal lines; and a threshold control circuit provided outside the pixel circuits or inside each of the pixel circuits, wherein, each pixel circuit corresponds to one of the scanning signal lines and one of the data signal lines, each pixel circuit includes a current-driven display element, a holding capacitor, and a drive transistor, the drive transistor includes a main control terminal for controlling a current flowing through the drive transistor and a threshold control terminal for controlling a threshold of the drive transistor, the main control terminal of the drive transistor is connected to the first power supply line via the holding capacitor, each pixel circuit is configured such that:

when the corresponding scanning signal line is selected, a voltage on the corresponding data signal line is written to the holding capacitor as a data voltage; and during an emission period for the display element, the drive transistor controls a drive current for the display element flowing in a path from the first power supply line through the drive transistor and the display element to the second power supply line, in accordance with a voltage being held by the holding capacitor, and for each pixel circuit, the threshold control circuit provides the threshold control terminal with a threshold control voltage during the emission period for the display element, the threshold control voltage causing the threshold of the drive transistor to change so as to compensate for a change of the voltage being held by the holding capacitor due to a leakage current within the pixel circuit.

Several other embodiments of the disclosure provide a method for driving a display device having a plurality of data signal lines, a plurality of scanning signal lines crossing the data signal lines, first and second power supply lines, and a plurality of pixel circuits arranged in a matrix along the data signal lines and the scanning signal lines, the method including:

a data signal line driving step of driving the data signal lines;

a scanning signal line driving step of selectively driving the scanning signal lines; and a threshold control step of controlling a threshold of drive transistors included in the pixel circuits, wherein, each pixel circuit corresponds to one of the scanning signal lines and one of the data signal lines, each pixel circuit includes a current-driven display element, a holding capacitor, and the drive transistor, the drive transistor includes a main control terminal for controlling a current flowing through the drive transistor and a threshold control terminal for controlling the threshold of the drive transistor, the main control terminal of the drive transistor is connected to the first power supply line via the holding capacitor, each pixel circuit is configured such that:

when the corresponding scanning signal line is selected, a voltage on the corresponding data signal line is written to the holding capacitor as a data voltage; and during an emission period for the display element, the drive transistor controls a drive current for the display element flowing in a path from the first power supply line through the drive transistor and the display element to the second power supply line, in accordance with a voltage being held by the holding capacitor, and in the threshold control step, for each pixel circuit, the threshold control terminal is provided with a threshold control voltage during the emission period for the display element, the threshold control voltage causing the threshold of the drive transistor to change so as to compensate for a change of the voltage being held by the holding capacitor due to a leakage current within the pixel circuit.

Effect of the Disclosure

In the above embodiments of the disclosure, for each pixel circuit of the display device, after a data voltage is written to the holding capacitor in the pixel circuit upon selection on a scanning signal line corresponding to the pixel circuit, even if the voltage that is being held by the holding capacitor changes due to a leakage current within the pixel circuit during the emission period, the threshold control voltage is provided to the threshold control terminal so as to change the threshold of the drive transistor and thereby compensate for the change of the voltage that is being held by the holding capacitor, i.e., a voltage change at the main control terminal of the drive transistor. As a result, the drive current can be inhibited from changing due to the change of the voltage that is being held by the holding capacitor. Thus, it is possible to prevent the occurrence of flickering due to the luminance of the display element changing in the refresh cycle. Moreover, flickering can be prevented even when the refresh cycle lasts long, as in the case of pause drive, and therefore the above embodiments in combination with pause drive makes it possible to display a satisfactory image without flickering being perceived while reducing power consumption.

DESCRIPTION OF EMBODIMENTS

Hereinafter, embodiments will be described with reference to the accompanying drawings. It should be noted that in each transistor to be mentioned below, a gate terminal thereof serves as a control terminal, and drain and source terminals thereof serve as first and second conductive terminals, respectively, or vice versa. Moreover, in the following embodiments, all transistors will be described as P-channel transistors, but the disclosure is not limited to this. Further, in the following embodiments, the transistors are, for example, thin-film transistors, but the disclosure is not limited to this. Still further, unless otherwise specified, the term "connection" as used herein is intended to mean "electrical connection" regardless of whether the connection is made directly or indirectly via another element without departing from the scope of the disclosure.

1. First Embodiment

<1.1 Overall Configuration>

Figure 1:
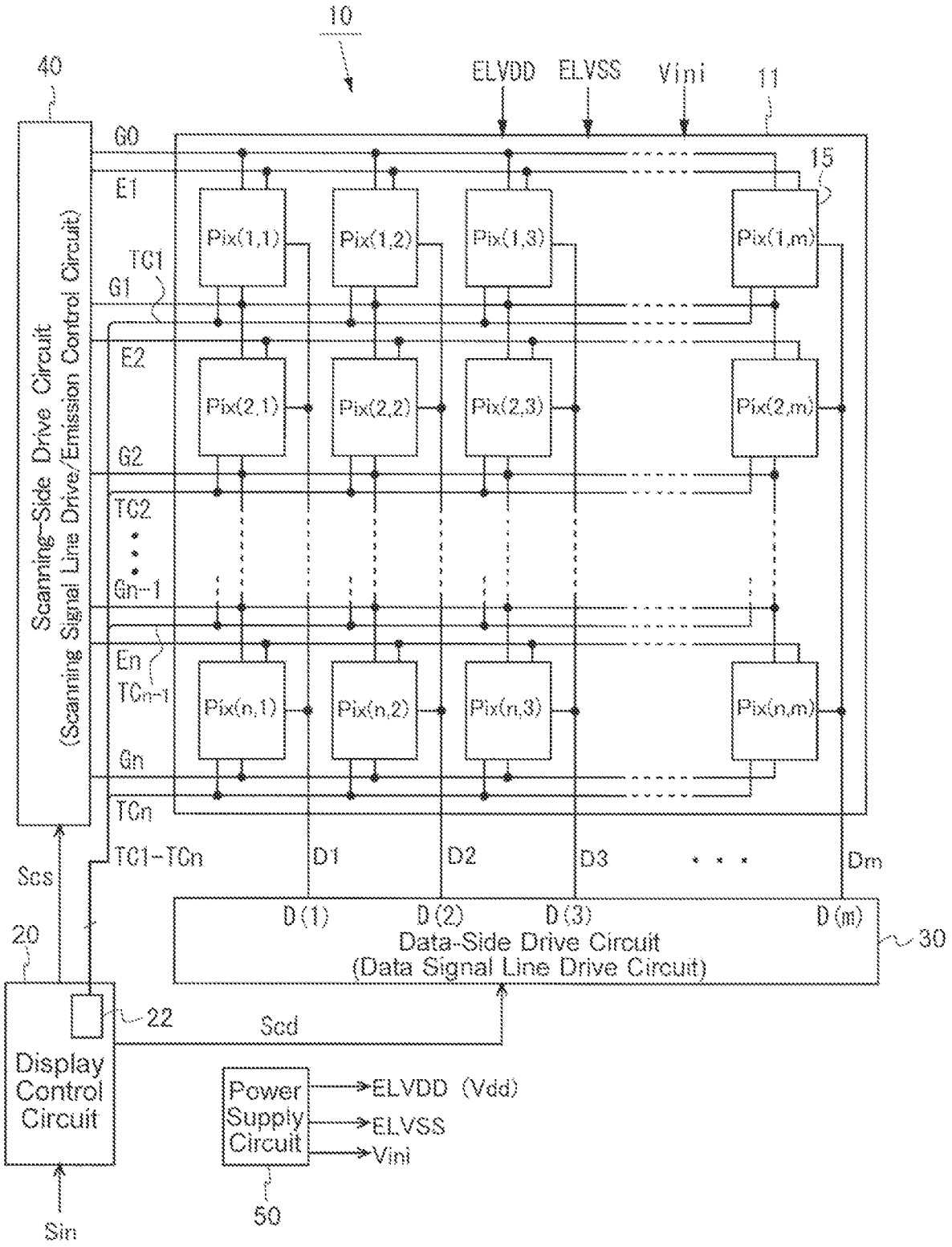
FIG. 1 is a block diagram illustrating an overall configuration of a display device according to a first embodiment.

FIG. 1 is a block diagram illustrating an overall configuration of an organic EL display device 10 according to a first embodiment. The display device 10 is an organic EL display device which performs internal compensation. Accordingly, in the display device 10, each pixel circuit has the function of compensating for variations and shifts in threshold voltage among internal drive transistors (details will be described later).

As shown in FIG. 1, the display device 10 includes a display portion 11, a display control circuit 20, a data-side drive circuit 30, a scanning-side drive circuit 40, and a power supply circuit 50. The data-side drive circuit functions as a data signal line drive circuit (also referred to as a "data driver"). The scanning-side drive circuit 40 functions as a scanning signal line drive circuit (also referred to as a "gate driver") and also as an emission control circuit (also referred to as an "emission driver"). In the configuration shown in FIG. 1, these two circuits included in the scanning driver's block are implemented as one scanning-side drive circuit 40 but may be suitably separated as individual circuits or separately arranged on opposite sides across the display portion 11. Moreover, the scanning-side drive circuit and the data signal line drive circuit may be at least in part integrally formed with the display portion 11. These similarly apply to other embodiments and variants to be described later. The power supply circuit 50 generates a high-level power supply voltage ELVDD, a low-level power supply voltage ELVSS, and an initialization voltage Vini, which are to be supplied to the display portion 11, as will be described below, and the power supply circuit 50 also generates a power supply voltage (not shown) to be supplied to the display control circuit 20, the data-side drive circuit 30, and the scanning-side drive circuit 40.

The display portion 11 is provided with m (where m is an integer of 2 or more) data signal lines D1 to Dm and n+1 (where n is an integer of 2 or more) scanning signal lines G0 to Gn crossing the data signal lines, and also includes n emission control lines (emission lines) E1 to En provided along the n respective scanning signal lines G1 to Gn. Moreover, the display portion 11 is provided with m×n pixel circuits 15 arranged in a matrix along the m data signal lines D1 to Dm and the n scanning signal lines G1 to Gn, and each pixel circuit 15 corresponds to one of the m data signal lines D1 to Dm and one of the n scanning signal lines G1 to Gn (to distinguish each pixel circuit 15 from the others, the pixel circuit that corresponds to the i'th scanning signal line Gi and the j'th data signal line Dj will also be referred to below as the "i'th-row, j'th-column pixel circuit" and denoted by the symbol "Pix(i,j)"). In the present embodiment, in addition to the above, the display portion 11 also includes n threshold control lines TC1 to TCn provided along the n respective scanning signal lines G1 to Gn. The n emission control lines E1 to En correspond to the n respective scanning signal lines G1 to Gn, and the n threshold control lines TC1 to TCn also correspond to the n respective scanning signal lines G1 to Gn. Accordingly, each pixel circuit 15 also corresponds to one of the n emission control lines E1 to En, and one of the n threshold control lines TC1 to TCn.

Moreover, the display portion 11 includes unillustrated power supply lines shared among the pixel circuits 15. More specifically, there is a power supply line for supplying a high-level power supply voltage ELVDD to drive organic EL elements to be described later (this power supply line will be referred to below as the "high-level power supply line" and denoted by the same symbol as the high-level power supply voltage, i.e., "ELVDD"), and there is also a power supply line for supplying a low-level power supply voltage ELVSS to drive the organic EL elements (this power supply line will be referred to below as the "low-level power supply line" and denoted by the same symbol as the low-level power supply voltage, i.e., "ELVSS"). More specifically, the low-level power supply line ELVSS acts as a common cathode for the pixel circuits 15. Further, the display portion 11 includes an unillustrated initialization voltage supply line provided for supplying an initialization voltage Vini to be used for a reset operation (also referred to as an "initialization operation") for initializing each pixel circuit 15 (this line will be denoted by the same symbol as the initialization voltage, i.e., "Vini"). The high-level power supply voltage ELVDD, the low-level power supply voltage ELVSS, and the initialization voltage Vini are supplied by the power supply circuit 50.

The display control circuit 20 receives an input signal Sin, which includes image information representing an image to be displayed and timing control information for image display, from outside the display device 10, generates a data control signal Scd and a scanning control signal Scs on the basis of the input signal Sin, and outputs the data control signal Scd to the data-side drive circuit (data signal line drive circuit) 30 and the scanning control signal Scs to the scanning-side drive circuit (scanning signal line drive circuit/emission control circuit) 40. Moreover, the display control circuit 20 includes a threshold control circuit 22 for generating and applying threshold control signals TC(1) to TC(n) to the threshold control lines TC1 to TCn, respectively, in the display portion 11 on the basis of the input signal Sin. The threshold control signals TC(1) to TC(n) will be described in detail later.

The data-side drive circuit 30 drives the data signal lines D1 to Dm in accordance with the data control signal Scd from the display control circuit 20. More specifically, in accordance with the data control signal Scd, the data-side drive circuit 30 outputs m data signals D(1) to D(m), which represent the image to be displayed, in parallel to the respective data signal lines D1 to Dm.

The scanning-side drive circuit 40 functions as a scanning signal line drive circuit for driving the scanning signal lines G0 to Gn and also as an emission control circuit for driving the emission control lines E1 to En, in accordance with the scanning control signal Scs from the display control circuit 20.

More specifically, in accordance with the scanning control signal Scs, the scanning-side drive circuit 40 serving as the scanning signal line drive circuit sequentially selects each of the scanning signal lines G0 to Gn for a predetermined time period, which corresponds to one horizontal period, during each frame period, and applies an active signal (low-level voltage) to the scanning signal line Gk that is being selected and inactive signals (high-level voltages) to the scanning signal lines that are not being selected. As a result, m pixel circuits Pix(k,1) to Pix(k,m) corresponding to the scanning signal line Gk that is being selected (where $1 \leq k \leq n$) are collectively selected. Consequently, during the period for which the scanning signal line Gk is being selected (referred to below as the "k'th scanning selection period"), voltages of the m data signals D(1) to D(m) applied to the data signal lines D1 to Dm by the data-side drive circuit 30 (these voltages will also be simply referred to below as the "data voltages" without distinction) are written to the respective pixel circuits Pix(k,1) to Pix(k,m) as pixel data.

Furthermore, in accordance with the scanning control signal Scs, the scanning-side drive circuit 40 serving as the emission control circuit applies an emission control signal (high-level voltage) that designates "non-emission" to the i'th emission control line Ei during the i'th horizontal period and an emission control signal (low-level voltage) that designates "emission" to the i'th emission control line Ei during other periods (see FIG. 6 to be described later). While the voltage on the emission control line Ei is at low level, organic EL elements in pixel circuits (also referred to below as "i'th row pixel circuits") Pix(i,1) to Pix(i,m) corresponding to the i'th scanning signal line Gi emit light with intensities corresponding to data voltages respectively being written to the i'th row pixel circuits Pix(i,1) to Pix(i,m).

<1.2 Overall Operation>

Figure 2:
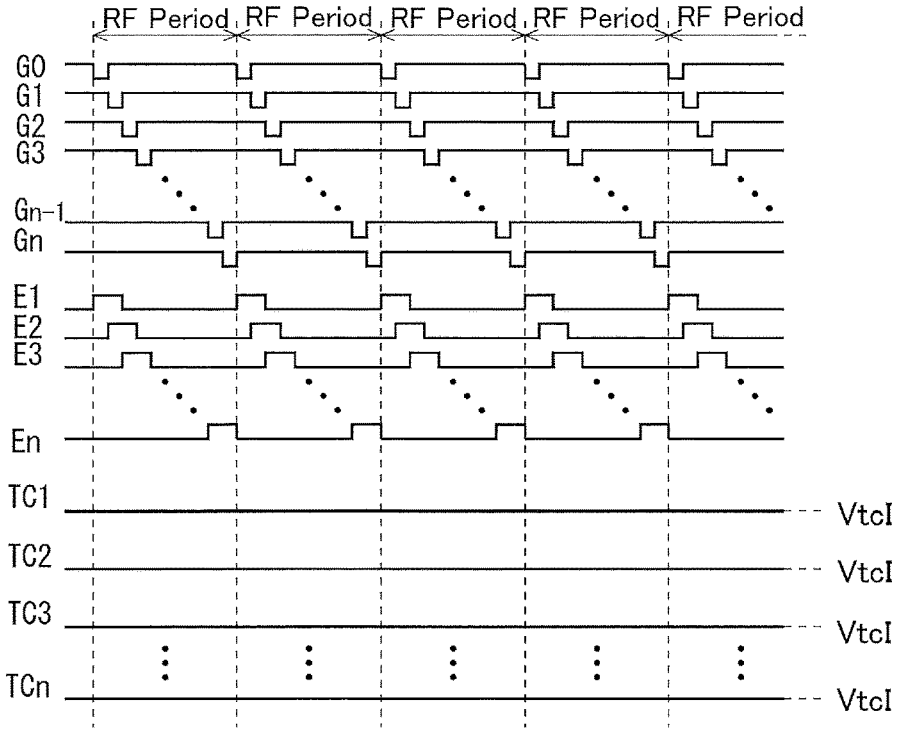
FIG. 2 is a signal waveform diagram illustrating an operation where the display device according to the first embodiment performs normal drive.
Figure 3:
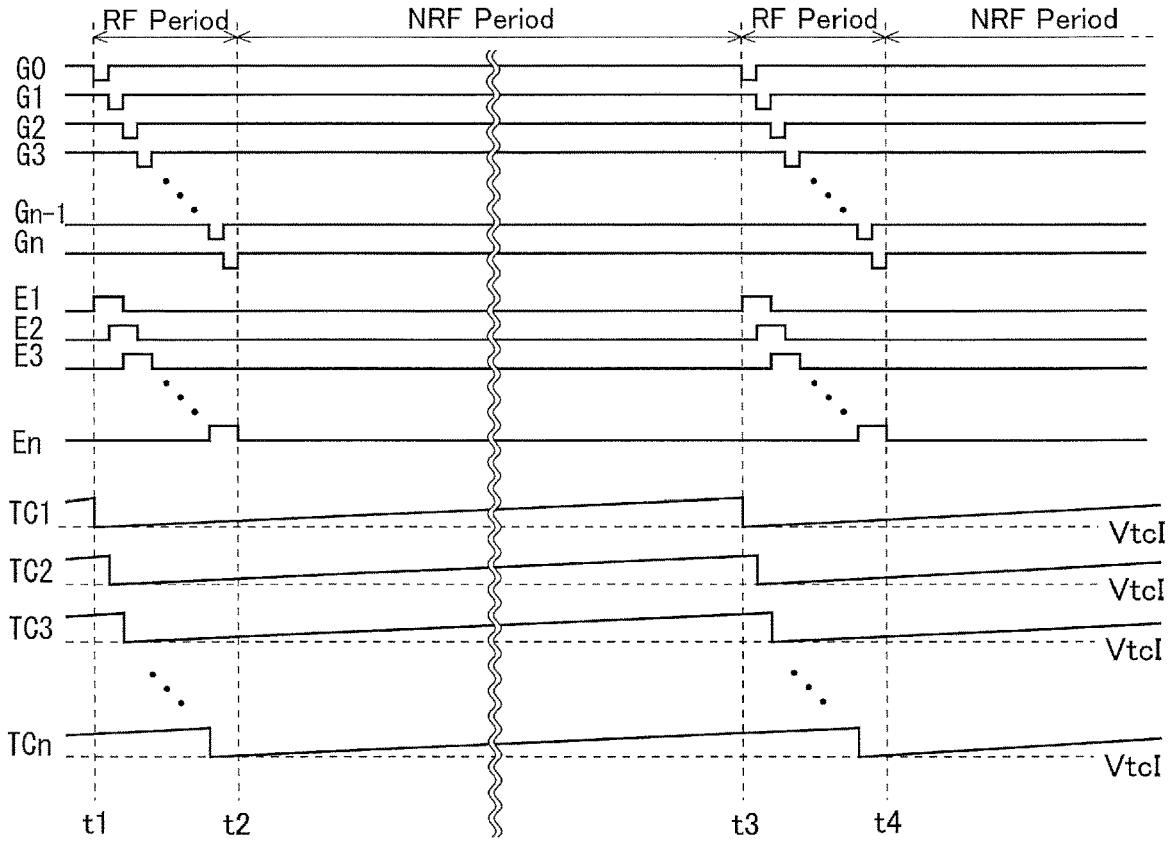
FIG. 3 is a signal waveform diagram illustrating an operation where the display device according to the first embodiment performs pause drive.

Next, the overall operation of the display device 10 according to the present embodiment will be described with reference to FIGS. 2 and 3. The display device 10 according to the present embodiment operates in two modes: normal drive mode and pause drive mode. In the normal drive mode, the scanning signal lines G0 to G1 are sequentially selected to write image data to the display portion 11 (i.e., the pixel circuits Pix(1,1) to Pix(n,m)) within one frame period during repeated refresh periods (also referred to below as "RF periods"), as shown in FIG. 2, and in the pause drive mode, the refresh period as above alternates with a non-refresh period (referred to below as an "NRF" period), during which the scanning signal lines G0 to G1 are kept unselected so as to stop image data from being written to the display portion 11, as shown in FIG. 3. In the pause drive mode, the scanning-side drive circuit and the data-side drive circuit stop operating during the non-refresh period, so that the image data that was written during the immediately preceding refresh period continues to be displayed. Accordingly, the pause drive mode is effective in reducing power consumption of the display device when still images are displayed.

The externally supplied input signal Sin includes an operation mode signal Sm designating the operation mode, either the normal or pause drive mode as described above, in which the display portion 11 is driven. The operation mode signal Sm is provided to the scanning-side drive circuit 40 as a portion of the scanning control signal Scs and also to the data-side drive circuit 30 as a portion of the data control signal Scd. The scanning-side drive circuit 40 drives the scanning signal lines G0 to Gn and the emission control lines E1 to En in accordance with the operation mode designated by the operation mode signal Sm, and the data-side drive circuit 30 drives the data signal lines D1 to Dn in accordance with the operation mode designated by the operation mode signal Sm. Moreover, the display control circuit 20 (i.e., the threshold control circuit 22 therein) drives the threshold control lines TC1 to TCn in accordance with the operation mode designated by the operation mode signal Sm.

In the present embodiment, for each pixel circuit Pix(i,j), the emission control line Ei is driven (where i=1 to N) such that a data writing operation is performed when the scanning signal line Gi corresponding to the pixel circuit Pix(i,j) is being selected, a reset operation is performed when the scanning signal line Gi−1 immediately preceding the scanning signal line Gi is being selected, and the pixel circuit Pix(i,j) is not lit up during periods in which the data writing operation or the reset operation is performed on the pixel circuit Pix(i,j). Specifically, during the RF period, each of the emission control lines E1 to En is sequentially activated for two horizontal periods in synchronization with the driving of the scanning signal lines G0 to Gn, as shown in FIGS. 2 and 3. Note that in the present embodiment, as will be described later, P-channel transistors are used as emission control transistors T5 and T6 of the pixel circuit Pix(i,j) (see FIG. 4 to be described later), and therefore each emission control line Ei is activated upon provision of a low-level (L-level) voltage and deactivated upon provision of a high-level (H-level) voltage.

Furthermore, in the normal drive mode, the voltage on each threshold control line TCi is maintained at a predetermined initial threshold control voltage VtcI, as shown in FIG. 2, so that the drive transistor in each pixel circuit Pix(i,j) does not change in threshold (details will be described later).

On the other hand, in the pause drive mode, the voltage on each threshold control line TCi is gradually increased over time during the NRF period (non-refresh period) and then decreased to the initial threshold control voltage VtcI during the following RF period (refresh period), as shown in FIG. 3. Note that in the pause drive mode, during the NRF period, each of the scanning signal lines G0 to Gn is kept unselected (at H level), and each of the emission control lines E1 to En is kept activated (at L level). Accordingly, during the NRF period, the scanning-side drive circuit and the data-side drive circuit stop operating, and each pixel circuit Pix(i,j) emits light continuously in accordance with the data voltage that is being held therein.

<1.3 Configuration of the Pixel Circuit>

Next, the configuration of the pixel circuit 15 in the present embodiment will be described with reference to FIGS. 4 and 5.

Figure 4:
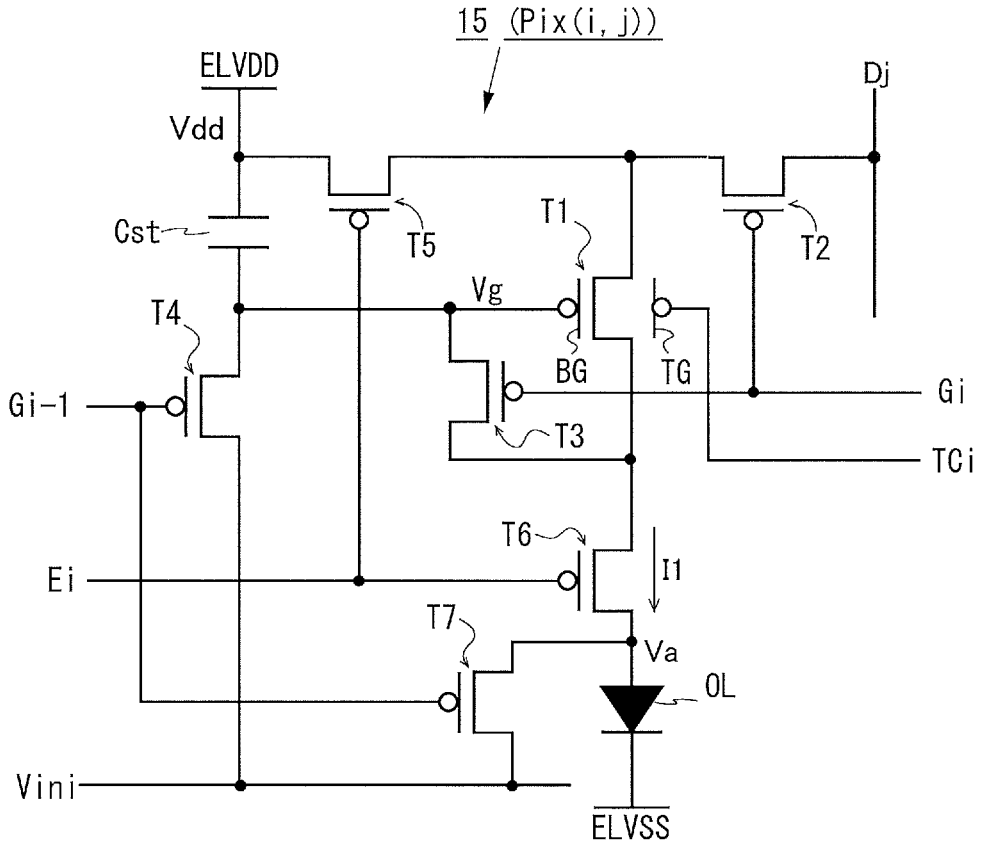
FIG. 4 is a circuit diagram illustrating a configuration of a pixel circuit in the first embodiment.

FIG. 4 is a circuit diagram illustrating the configuration of the pixel circuit 15 in the present embodiment, more specifically, the pixel circuit 15 corresponding to the i'th scanning signal line Gi and the j'th data signal line Dj, i.e., the circuit diagram illustrates the configuration of the i'th-row, j'th-column pixel circuit Pix(i,j) (where $1 \leq i \leq n$, and $1 \leq j \leq m$). As shown in FIG. 4, the pixel circuit 15 includes an organic EL element OL, which serves as a display element, a drive transistor T1, a write control transistor T2, a threshold compensation transistor T3, a first initialization transistor T4, a first emission control transistor T5, a second emission control transistor T6, a second initialization transistor T7, and a holding capacitor Cst. In the pixel circuit 15, the transistors T2 to T7, i.e., all the transistors excluding the drive transistor T1, function as switching elements.

The pixel circuit 15 is connected to a scanning signal line Gi corresponding thereto (also referred to below as a "corresponding scanning signal line" in descriptions focusing on the pixel circuit), a scanning signal line Gi−1 immediately preceding the corresponding scanning signal line Gi (this scanning signal line immediately precedes in order of scanning among the scanning signal lines G1 to Gn and will also be referred to below as the "preceding scanning signal line" in descriptions focusing on the pixel circuit), an emission control line Ei corresponding to the pixel circuit (also referred to below as a "corresponding emission control line" in descriptions focusing on the pixel circuit), a threshold control line TCi corresponding to the pixel circuit (also referred to below as a "corresponding threshold control line" in descriptions focusing on the pixel circuit), a data signal line Dj corresponding to the pixel circuit (also referred to below as a "corresponding data signal line" in descriptions focusing on the pixel circuit), an initialization voltage supply line Vini, a high-level power supply line ELVDD, and a low-level power supply line ELVSS.

In the pixel circuit 15, the drive transistor T1 is connected at a source terminal to the corresponding data signal line Dj via the write control transistor T2 and also to the high-level power supply line ELVDD via the first emission control transistor T5, as shown in FIG. 4. The drive transistor T1 is connected at a drain terminal to an anode of the organic EL element OL via the second emission control transistor T6. The drive transistor T1 is connected at a gate terminal to the high-level power supply line ELVDD via the holding capacitor Cst, to the drain terminal of the drive transistor T1 via the threshold compensation transistor T3, and to the initialization voltage supply line Vini via the first initialization transistor T4. The organic EL element OL is connected at the anode to the initialization voltage supply line Vini via the second initialization transistor T7, and also connected at a cathode to the low-level power supply line ELVSS. Moreover, the write control transistor T2 and the threshold compensation transistor T3 are connected at gate terminals to the corresponding scanning signal line Gi, the first and second emission control transistors T5 and T6 are connected at gate terminals to the corresponding emission control line Ei, and the first initialization transistor T4 and the second initialization transistor T7 are connected at gate terminals to the preceding scanning signal line Gi−1. In the present embodiment, the drive transistor T1 of the pixel circuit 15 is a thin-film transistor having a top gate electrode TG and a bottom gate electrode BG (details will be described later). Note that the gate terminal of the second initialization transistor T7 may be connected to the corresponding scanning signal line Gi instead of the preceding scanning signal line Gi−1.

Figure 5:
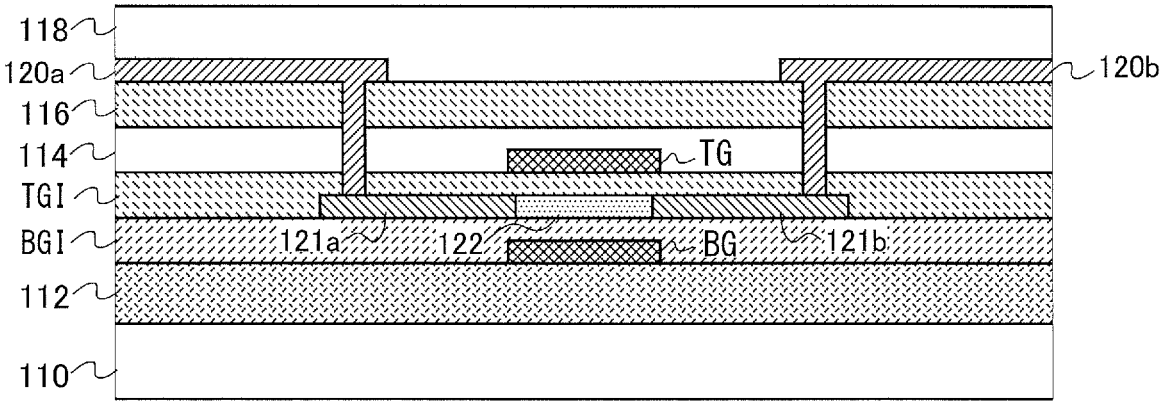
FIG. 5 is a cross-sectional view schematically illustrating a structure of a drive transistor included in the pixel circuit in the first embodiment.

FIG. 5 is a cross-sectional view illustrating a configuration example of the drive transistor T1. As shown in FIG. 5, formed on an insulator substrate 110, which is a glass substrate or a flexible substrate formed of a resin material such as polyimide, is an inorganic insulating film 112 serving as a moisture-proof layer, on which are formed a bottom gate electrode BG and a gate insulating film BGI covering the bottom gate electrode BG. Formed on the gate insulating film BGI is a semiconductor layer including an intrinsic semiconductor 122, which serves as a channel region, and conductors 121*a* and 121*b*, which serve as source and drain regions, respectively, and are formed on opposite sides with the channel region positioned therebetween. Further formed on the semiconductor layer thus configured is a gate insulating film TGI, on which a top gate electrode TG is formed. The top gate electrode TG is covered by a first inorganic insulating film 114, on which a second inorganic insulating film 116 is formed, and formed on the second inorganic insulating film 116 are metal layers 120*a* and 120*b* for electrical connections to other elements. The conductor 121*a*, i.e., the source region, is electrically connected to the metal layer 120*a* via a contact hole, and the conductor 121*b*, i.e., the drain region, is electrically connected to the metal layer 120*b* via a contact hole. Formed on the second inorganic insulating film 116 is an insulating layer 118, which is a planarizing layer covering the metal layers 120*a* and 120*b*.

As described above, the drive transistor T1 includes the top gate electrode TG and the bottom gate electrode BG, the top gate electrode TG is positioned opposite to one surface (in the figure, the top surface) of the channel region (intrinsic semiconductor layer) 122 with the gate insulating film TGI positioned therebetween, and the bottom gate electrode BG is positioned opposite to the other surface of the channel region 122 with the gate insulating film BGI positioned therebetween (see FIG. 5). In the following, the configuration that has gate electrodes on opposite surfaces of the channel region, as described above, will be referred by the term "double-gate". In the case of such a double-gate transistor, one of the two gate electrodes can be used as an essential control terminal (i.e., a terminal for controlling a current flowing through the transistor), and the other gate electrode can be used as a terminal for controlling a threshold of the transistor with a voltage supplied thereto. In the present embodiment, of the two gate electrodes BG and TG of the drive transistor T1, the bottom gate electrode BG is used as a main gate terminal (also referred to as a "main control terminal") for controlling a source-drain current, and the top gate electrode TG is used as a threshold control terminal for controlling a threshold of the drive transistor T1. Accordingly, the drive transistor T1 is connected at the bottom gate electrode BG, i.e., the main gate terminal, to the holding capacitor Cst and at the top gate electrode TG, i.e., the threshold control terminal, to the corresponding threshold control line TCi. Note that the term "gate terminal", when simply mentioned below, refers to the "main gate terminal".

The drive transistor T1 is operated in the saturation region, and the organic EL element OL has a drive current I1, as given by equation (1) below, flowing therethrough during the emission period. Equation (1) includes a gain β of the drive transistor T1, which is given by equation (2) below.

$$I1=(\beta/2)(|Vgs|-|Vth|)^2$$

$$=(\beta/2)(|Vg-\mathrm{ELVDD}|-|Vth|)^2 \quad (1)$$

$$\beta=\mu\times(W/L)\times Cox \quad (2)$$

In equations (1) and (2), Vgs, Vth, μ, W, L, and Cox respectively represent a gate-source voltage, a threshold, a mobility, a gate width, a gate length, and a gate insulating film capacitance per unit area of the drive transistor T1.

<1.4 Operation of the Pixel Circuit>

Next, the operation of the pixel circuit 15 in the present embodiment will be described with reference to FIGS. 6 and 7.

Figure 6:
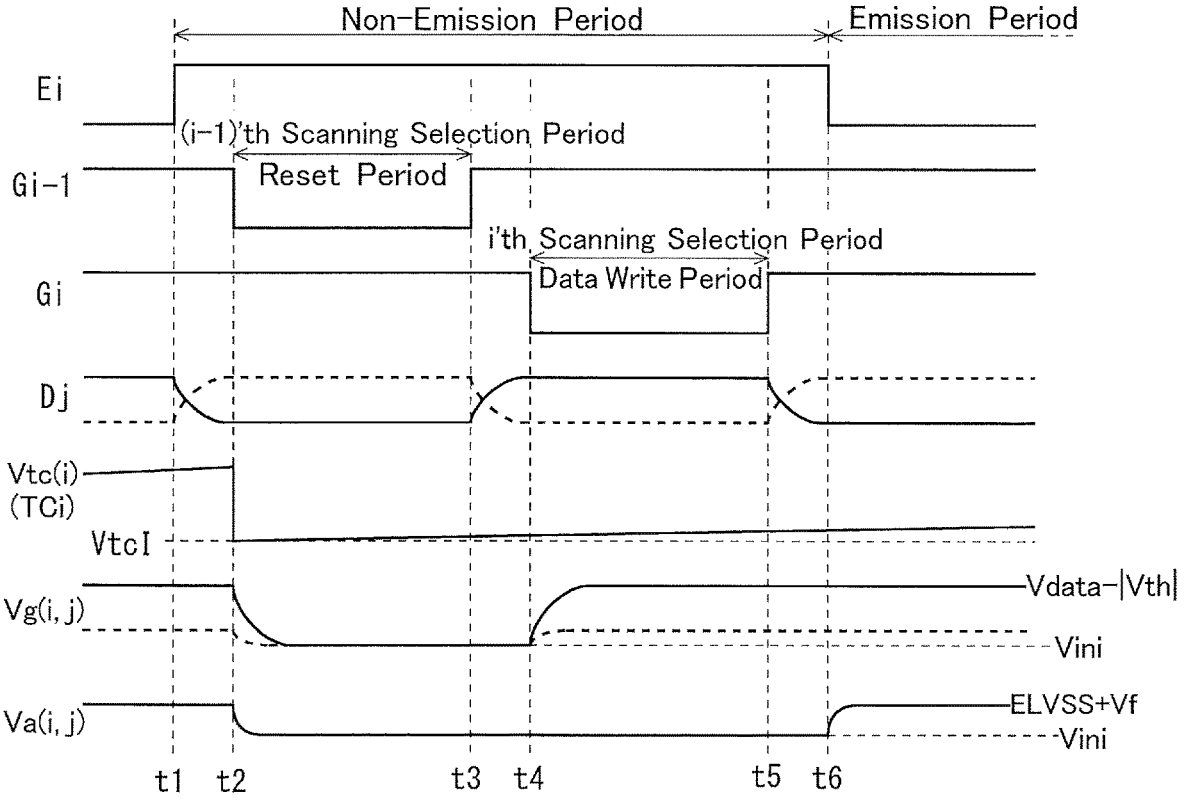
FIG. 6 is a signal waveform diagram for describing an operation of the pixel circuit in the first embodiment.

FIG. 6 is a signal waveform diagram for describing the operation of the pixel circuit in the present embodiment. (A) of FIG. 7 is a circuit diagram illustrating a reset operation of the pixel circuit 15 in the present embodiment, (B) of FIG. 7 is a circuit diagram illustrating a data writing operation of the pixel circuit 15, and (C) of FIG. 7 is a circuit diagram illustrating a lighting operation of the pixel circuit 15.

FIG. 6 shows changes in voltages on the signal lines (the corresponding emission control line Ei, the preceding scanning signal line Gi−1, the corresponding scanning signal line Gi, the corresponding data signal line Dj, and the threshold control line TCi), the voltage Vg on the main gate terminal of the drive transistor T1 (referred to below as the "gate voltage"), and the voltage Va on the anode of the organic EL element OL (referred to below as the "anode voltage") during reset, data writing, and lighting operations of the pixel circuit 15 configured as described above and shown in FIG. 4, i.e., the i'th-row, j'th-column pixel circuit Pix(i,j). In FIG. 6, the period from time t1 to time t6 corresponds to a non-emission period for the i'th row pixel circuits Pix(i,1) to Pix(i,m). The period from time t2 to time t4 corresponds to the (i−1)'th horizontal period, and the period from time t2 to time t3 corresponds to a selection period for the (i−1)'th scanning signal line (preceding scanning signal line) Gi−1, i.e., the (i−1)'th scanning selection period. The (i−1)'th scanning selection period coincides with a reset period for the i'th row pixel circuits Pix(i,1) to Pix(i,m). The period from time t4 to time t6 corresponds to the i'th horizontal period, and the period from time t4 to time t5 corresponds to a selection period for the i'th scanning signal line (corresponding scanning signal line) Gi, i.e., the i'th scanning selection period. The i'th scanning selection period coincides with a data write period for the i'th row pixel circuits Pix(i,1) to Pix(i,m).

For the i'th-row, j'th-column pixel circuit Pix(i,j), once the voltage on the emission control line Ei is changed from L to H level at time t1, as shown in FIG. 6, the first and second emission control transistors T5 and T6 transition from an ON state to an OFF state, with the result that the organic EL element OL is rendered in a non-emission state.

At time t2, the voltage on the preceding scanning signal line Gi−1 is changed from H to L level, with the result that the preceding scanning signal line Gi−1 is selected. Accordingly, the first initialization transistor T4 transitions to an ON state. Consequently, the voltage on the main gate terminal of the drive transistor T1, i.e., the gate voltage Vg, is initialized to the initialization voltage Vini. The initialization voltage Vini is a voltage large enough to maintain the drive transistor T1 in an ON state while the data voltage is being written to the pixel circuit Pix(i,j). Moreover, once the preceding scanning signal line Gi−1 is selected at time t2, the second initialization transistor T7 also transitions to an ON state. As a result, charge stored on parasitic capacitance of the organic EL element OL is released, so that the anode voltage Va of the organic EL element is initialized to the initialization voltage Vini (see FIG. 6). Note that to distinguish the anode voltage Va of the pixel circuit Pix(i,j) from an anode voltage Va of another pixel circuit, the symbol "Va(i,j)" is used (the same applies to descriptions below). Further, in the present embodiment, the voltage on the corresponding threshold control line TCi is initialized to the predetermined initial threshold control voltage VtcI at time t2 and thereafter gradually increased until the preceding scanning signal line Gi−1 is selected during the next frame period (i.e., until the start of the (i−1)'th selection scanning period within the next frame period).

The period from time t2 to time t3 corresponds to a reset period for the i'th row pixel circuits Pix(i,1) to Pix(i,m), and in the pixel circuit Pix(i,j), the first initialization transistor T4 is in the ON state during the reset period, as described earlier. (A) of FIG. 7 schematically shows the state of the pixel circuit Pix(i,j) during the reset period, i.e., the circuit state during the reset operation. In (A) of FIG. 7, dotted circles enclosing transistors which serve as switching elements represent that the transistors are in an OFF state, and dotted rectangles enclosing transistors which serve as switching elements represent that the transistors are in an ON state (these representations are also used in (B) and (C) of FIG. 7). During the reset period, the first and second initialization transistors T4 and T7 are in the ON state, as shown in (A) of FIG. 7. FIG. 6 shows the change of the gate voltage Vg(i,j) of the pixel circuit Pix(i,j) during the period. It should be noted that the symbol "Vg(i,j)" is used to distinguish the gate voltage Vg of the pixel circuit Pix(i,j) from gate voltages Vg of other pixel circuits (the same applies to descriptions below).

At time t3, the voltage on the preceding scanning signal line Gi−1 is changed to H level, with the result that the preceding scanning signal line Gi−1 is deselected. Accordingly, the first initialization transistor T4 transitions to an OFF state. During the period from time t3 to the start of the i'th scanning selection period at time t4, the data-side drive circuit 30 starts applying a data signal D(j) to the data signal line Dj as a data voltage for the i'th-row, j'th-column pixel, and the data signal D(j) continues to be applied at least until the end of the i'th scanning selection period at time t5.

At time t4, the voltage on the corresponding scanning signal line Gi is changed from H to L level, as shown in FIG. 6, with the result that the corresponding scanning signal line Gi is selected. Accordingly, in the pixel circuit Pix(i,j), the write control transistor T2 and the threshold compensation transistor T3 transition to an ON state.

The period from time t4 to time t5 corresponds to the data write period for the i'th-row pixel circuits Pix(i,1) to Pix(i,m), and during the data write period, the write control transistor T2 and the threshold compensation transistor T3 are in the ON state, as described earlier. (B) of FIG. 7 schematically shows the state of the pixel circuit Pix(i,j) during the data write period, i.e., the circuit state during the data writing operation. During the data write period, the voltage on the corresponding data signal line Dj is supplied as a data voltage Vdata to the holding capacitor Cst via the diode-connected drive transistor T1. Accordingly, the gate voltage Vg(i,j) is changed, as shown in FIG. 6, toward a value as given by equation (5) below.

$$Vg(i,j)=V\text{data}-|Vth| \tag{5}$$

Specifically, during the data write period, the data voltage that has been subjected to threshold compensation is written to the holding capacitor Cst, with the result that the gate voltage Vg(i,j) takes a value as given by equation (5).

Thereafter, at time t6, the voltage on the emission control line Ei is changed to L level. Correspondingly, the first and second emission control transistors T5 and T6 transition to the ON state. The emission period starts and continues from time t6, and during the emission period, in the pixel circuit Pix(i,j), the first and second emission control transistors T5 and T6 are in the ON state, the write control transistor T2, the threshold compensation transistor T3, the first initialization transistor T4, and the second initialization transistor T7 are in the OFF state, as described earlier. (C) of FIG. 7 schematically shows the state of the pixel circuit Pix(i,j) during the emission period, i.e., the circuit state during the lighting operation. During the emission period (from time t6 onward), the current I1 flows from the high-level power supply line ELVDD to the low-level power supply line ELVSS by way of the first emission control transistor T5, the drive transistor T1, the second emission control transistor T6, and the organic EL element OL. The current I1 is given by equation (1). Given that the drive transistor T1 is of a P-channel type and ELVDD>Vg, the current I1 is given by the following equation based on equations (1) and (5).

$$\begin{aligned} I1&=(\beta/2)(\text{ELVDD}-Vg-|Vth|)^2\\ &=(\beta/2)(\text{ELVDD}-V\text{data})^2 \end{aligned} \tag{6}$$

Accordingly, after time t6, the drive current I1 corresponding to the data voltage Vdata, which is the voltage on the corresponding data signal line Dj during the i'th scanning selection period, flows through the organic EL element OL, so that the organic EL element OL emits light with an intensity corresponding to the data voltage Vdata, regardless of the threshold Vth of the drive transistor T1.

In the case of display devices which use pixel circuits configured such that data voltages are written to holding capacitors via diode-connected drive transistors after gate voltages of the drive transistors are initialized, as in the present embodiment, each pixel circuit is controlled such that the organic EL element emits no light not only during the data write period for the pixel circuit (the i'th scanning selection period shown in FIG. 6) but also during the preceding reset period (the (i−1)'th scanning selection period shown in FIG. 6), with the result that no light is emitted at least during both periods.

<1.5 Configuration and Operation for Threshold Control>

Figure 8:
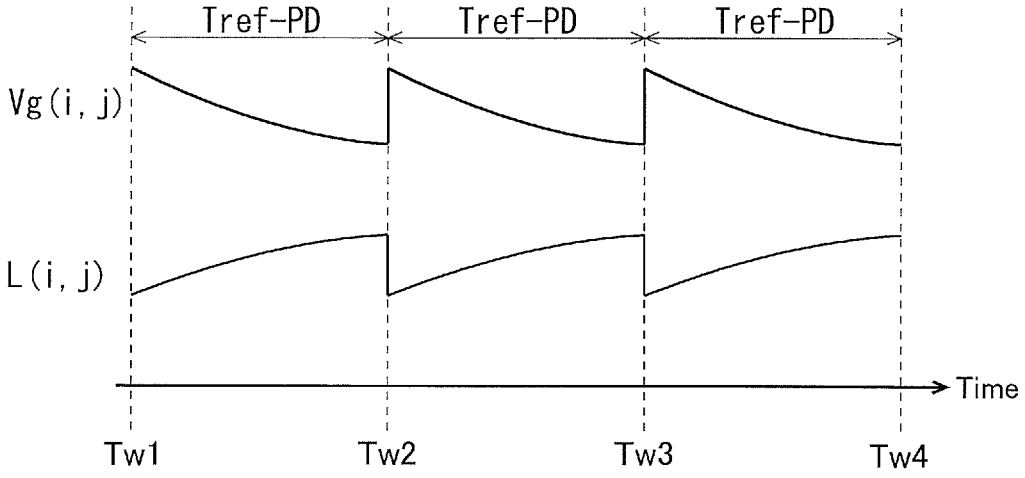
FIG. 8 is a waveform diagram for describing problems in the case where pause drive is performed without threshold control on the drive transistor.
Figure 9:
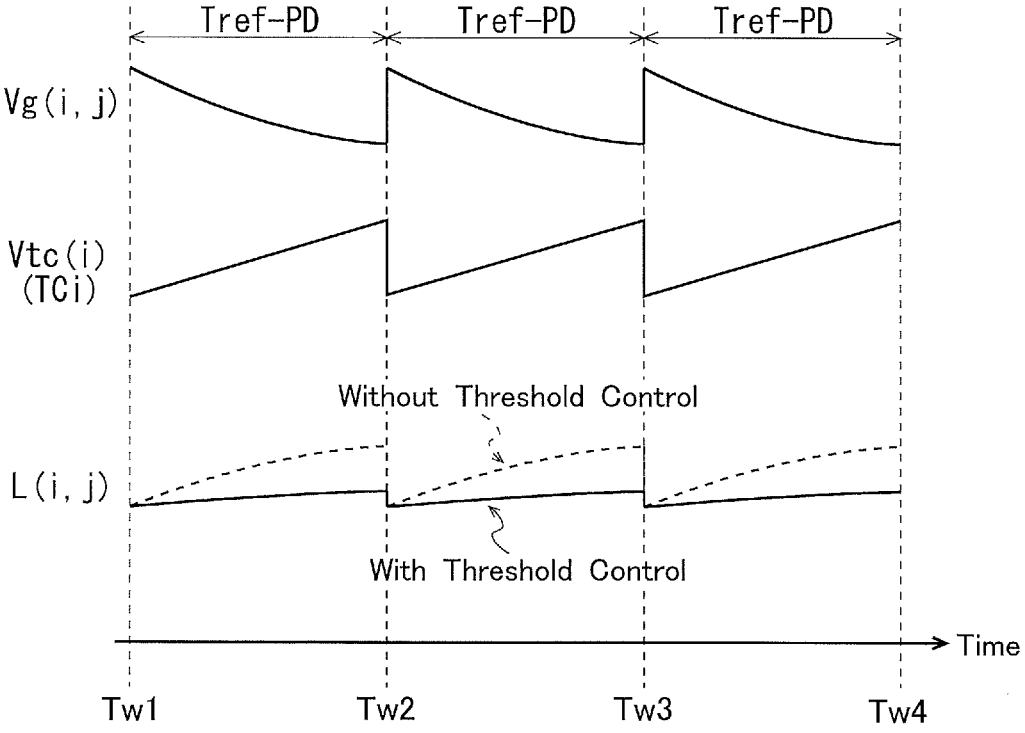
FIG. 9 is a waveform diagram for describing working effects of the first embodiment.

In the present embodiment, in the pause drive mode, the threshold Vth of the drive transistor T1 in each pixel circuit Pix(i,j) is controlled by the voltage on the threshold control line TCi, i.e., the voltage Vtc(i) of the threshold control signal TC(i) (referred to below as the "threshold control voltage"), which is provided to the threshold control terminal (top gate electrode) TG of the drive transistor T1, as described above (see FIGS. 3 and 6). Before describing working effects of the present embodiment, problems in the case where no threshold control is performed on the drive transistor T1 in the pause drive mode will be described first. Note that, of the figures to be referred to in the following descriptions, FIG. 8 is a waveform diagram for describing problems in the case where pause drive is performed without controlling the threshold of the drive transistor, and FIG. 9 is a waveform diagram for describing working effects of the present embodiment.

In the pause drive mode, one long NRF period occurs between two adjacent RF periods, as shown in FIG. 3, and therefore the cycle in which a data voltage is written to the pixel circuit Pix(i,j) (i.e., the refresh cycle) is much longer than in the normal drive mode and lasts, for example, for about 0.1 seconds or longer (which corresponds to a refresh rate of 10 Hz or less). Accordingly, during the emission period including the NRF period, the amount of change in charge stored on the holding capacitor Cst significantly increases due to a leakage current Ioff through the first initialization transistor T4 in the OFF state. As a result, in the pause drive mode, the amount of decrease in the gate voltage Vg(i,j) of the drive transistor T1 per refresh cycle Tref-PD increases as well. The gate voltage Vg(i,j) thus decreased rises upon another occurrence of data voltage writing during the next RF period (times Tw1 to Tw4 in FIG. 8 indicates times at which such writing occurs). Accordingly, in the pause drive mode, the gate voltage Vg(i,j) of the drive transistor T1 changes periodically in the refresh cycle Tref-PD, as shown in FIG. 8. Correspondingly, the luminance L(i,j) of the organic EL element OL in the pixel circuit Pix(i,j) gradually increases, as shown in FIG. 8, and such a gradual luminance increase is perceived as flickering.

On the other hand, in the present embodiment, for each pixel circuit Pix(i,j), the threshold control line TCi is driven such that the voltage Vtc(i), which is provided to the threshold control terminal TG of the drive transistor T1 in the pixel circuit Pix(i,j), changes as shown in FIGS. 3 and 6. As a result, the absolute value |Vth| of the threshold of the drive transistor T1 gradually rises during the emission period including the NRF period and falls to the initial threshold control voltage VtcI at the start of the (i−1)'th selection scanning period at time t2 during the next RF period (the start substantially coincides with the time of data writing at each of times Tw1 to Tw4 shown in FIG. 9). As a result, in the pause drive mode, the threshold control voltage Vtc(i) provided to the threshold control terminal TG of the drive transistor T1 changes periodically in the refresh cycle Tref-PD, as shown in FIG. 9.

Here, since the drive transistor T1 is of a P-channel type, the positively higher the voltage Vtc(i) provided to the threshold control terminal TG becomes, the larger the absolute value |Vth| of the threshold of the drive transistor T1 becomes (i.e., less current flows). As can be appreciated from equation (1) described earlier, the increase in the absolute value |Vth| of the threshold causes the drive transistor T1 to decrease the drive current I1 of the organic EL element OL and thereby decrease the luminance of the organic EL element OL. Accordingly, by appropriately setting the rate of change in the threshold control voltage Vtc(i) during the emission period in accordance with the characteristics of the drive transistor T1, it is rendered possible to reduce the change in the luminance L(i,j) of the organic EL element OL in the pixel circuit Pix(i,j), as indicated by the solid line in FIG. 9. Thus, in the pause drive mode, it is possible to inhibit the occurrence of flickering due to the amount of charge stored on the holding capacitor Cst changing due to a leakage current through the first initialization transistor T4.

Described below is a specific method for setting the threshold control voltage Vtc(i) to inhibit the occurrence of flickering as described above.

The drive current I1, which flows from the drive transistor T1 to the organic EL element OL during the emission period, is given by equation (1) described earlier. Here, for the convenience of description, assuming that Vdd=ELVDD and also that, given that the drive transistor T1 is of a P-channel type, Vdd>Vg, the drive current I1 can be expressed by the following equation:

$$I1=(\beta/2)(Vdd-Vg-|Vth|)^2 \tag{7}$$

Moreover, since the gate voltage Vg=Vg(i,j) changes due to a leakage current Ioff through the first initialization transistor T4 during the emission period, the gate voltage Vg is considered to be a function of time t and therefore represented by Vg(t), and assuming that the end of the data write period for the pixel circuit Pix(i,j) at time t5 is represented by t=0 (see FIG. 6), the gate voltage in the present embodiment, in which internal compensation is performed, can be given as follows by equation (5) described earlier:

$$Vg(0)=V\text{data}-|Vth| \tag{8}$$

Figure 7:
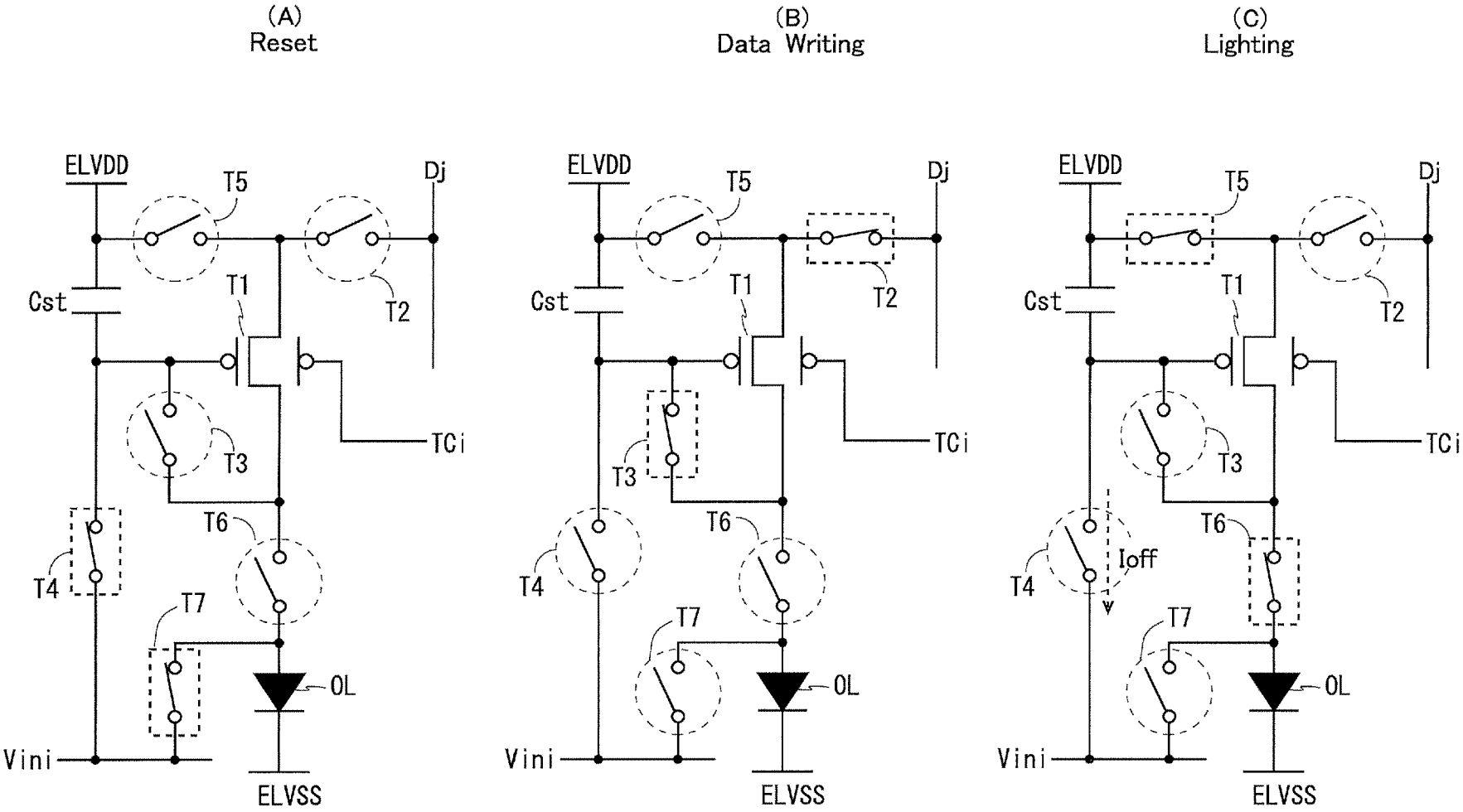
FIG. 7 provides (A) a circuit diagram illustrating a reset operation of the pixel circuit in the first embodiment, (B) a circuit diagram illustrating a data writing operation of the pixel circuit, and (C) a circuit diagram illustrating a lighting operation of the pixel circuit.

The gate voltage Vg(t), which changes due to the leakage current Ioff through the first initialization transistor T4 in the OFF state during the emission period, can be expressed by the following equation, from FIG. 4 and (C) of FIG. 7:

$$Vg(t)=(Vg(0)-Vini)\exp(-t/(Cst\cdot Roff))+Vini \tag{9}$$

Here, Vini, Cst, and Roff respectively represent an initialization voltage, a capacitance value of the holding capacitor Cst, an OFF resistance of the first initialization transistor T4.

Given the change of the gate voltage Vg due to the leakage current Ioff through the first initialization transistor T4, the drive current I1 can be expressed by the following equation using Vg(t) as obtained by equation (8) and (9).

$$I1=(\beta/2)(Vdd-Vg(t)-|Vth|)^2 \tag{10}$$

Accordingly, when no threshold control is performed on the drive transistor T1 in the pause drive mode, as can be seen from equations (8) and (9), the gate voltage Vg(t) gradually falls from Vg(0) as given by equation (8) during the emission period following the data write period for the pixel circuit Pix(i,j) and then rises to Vg(0) as given by equation (8) by virtue of data voltage writing during the next RF period. Specifically, the gate voltage Vg changes periodically in the refresh cycle Tref-PD in the pause drive mode, as shown in FIG. 8. Once the gate voltage Vg changes in this manner, as can be seen from equations (8) and (10), the drive current I1 gradually increases during the emission period following the data write period, from the value given by the following:

$$I1=(\beta/2)(Vdd-Vg(0)-|Vth|)^2$$

$$=(\beta/2)(Vdd-V\text{data})^2,$$

and by virtue of data voltage writing during the next RF period, the drive current I1 decreases to the value given by the following:

$$I1=(\beta/2)(Vdd-V\text{data})^2$$

Correspondingly, the luminance L(i,j) of the current-driven organic EL element OL changes periodically in the refresh cycle Tref-PD in the pause drive mode, as shown in FIG. 8. Such changes in the luminance L(i,j) of the organic EL element OL are perceived as flickering.

On the other hand, in the present embodiment, in the pause drive mode, the threshold Vth of the drive transistor T1 is controlled by providing the threshold control voltage Vtc(i) to the threshold control terminal (top gate electrode) TG of the drive transistor T1 in each pixel circuit Pix(i,j) via the threshold control line TCi. To enable this to inhibit the drive current I1 from changing due to changes of the gate voltage Vg, the threshold is considered to be a function Vth(t) of time t and ideally controlled such that:

$$Vg(t)+|Vth(t)|=Vg(0)+|Vth(0)| \tag{11}$$

This renders it possible to keep the drive current I1 from changing and maintain the drive current I1 at a value given by the following equation based on equation (10):

$$I1=(\beta/2)(Vdd-Vg(0)-|Vth(0)|)^2 \tag{12}$$

Here, Vg(t) as given by equation (9) is approximated by the following equation, considering the value t/(Cst·Roff) to be sufficiently low:

$$Vg(t)=(Vg(0)-Vini)(1-t/(Cst\cdot Roff))+Vini \tag{13}$$

Equations (11) and (13) yield the following:

$$|Vth(t)|=|Vth(0)|+(Vg(0)-Vini)t/(Cst\cdot R\text{off}) \tag{14}$$

Meanwhile, as in the present embodiment, when the top gate electrode TG of the drive transistor T1 serves as the threshold control terminal, the absolute value |Vth| of the threshold can be expressed by the following linear expression for the voltage Vtg on the top gate electrode TG.

$$|Vth|=a\cdot Vtg+b$$

In the present embodiment, the threshold control voltage Vtc(i) is provided to the top gate electrode TG as Vtg, and therefore the above equation can be rewritten as follows:

$$|Vth|=a\cdot Vtc(i)+b \tag{15}$$

In equation (15), a is a constant equal to the gate insulating film capacitance ratio Ct/Cb between the top gate electrode TG and the bottom gate electrode BG (i.e., a=Ct/Cb). In the present embodiment, in the pause drive mode, the threshold Vth is changed by changing the threshold control voltage Vtc(i) provided to the top gate electrode TG as Vtg, and therefore when these two values are considered as functions Vth(t) and Vtc(i,t) of time t and the threshold control voltage is assumed to be such that Vtc(i,0)=VtcI where t=0, equation (15) yields the following:

$$b=|Vth(0)|-a\cdot VtcI$$

This equation and equation (15) yield the following equation:

$$Vtc(i,t)=\{|Vth(t)|-b\}/a$$

$$=\{|Vth(t)|-|Vth(0)|+a\cdot VtcI\}/a \tag{16}$$

By substituting equation (14) into equation (16), the following can be obtained:

$$Vtc(i,t)=VtcI+(Vg(0)-Vini)t/\{(Cst\cdot R\text{off})\cdot a\}$$

$$=VtcI+(Vg(0)-Vini)t/\{(Cst\cdot R\text{off})(Ct/Cb)\} \tag{17}$$

Accordingly, in the present embodiment, in the pause drive mode, the threshold control circuit 22 generates and applies threshold control signals TC(1) to TC(n) to the threshold control lines TC1 to TCn, respectively, during the period (corresponding to one refresh cycle Tref-PD) that lasts from data voltage writing at time t=0 until data voltage writing during the next RF period following the emission period (including the NRF period), such that the threshold control voltage Vtc(i), which changes in accordance with equation (17), is provided to the threshold control terminal (top gate electrode) TG of the drive transistor T1 in each pixel circuit Pix(i,j) (where i=1 to n, and j=1 to m) via the threshold control line TCi (see FIGS. 3 and 9). Here, the threshold control voltage Vtc(i,t) as given by equation (17) corresponds to the voltage of the threshold control signal TC(i).

It should be noted that Vg(0) in equation (17) is given by equation (5) described earlier such that:

$$Vg(0)=V\text{data}-|Vth(0)|,$$

and therefore the threshold control voltage Vtc(i,t) as given by equation (17) depends on the data voltage Vdata that is to be written to the pixel circuit Pix(i,j), i.e., the voltage on the corresponding data signal line Dj. However, given this dependence, the threshold control voltage Vtc(i,t) may be generated in accordance with equation (17) using a gate voltage Vg(0)=Vdrp−|Vth(0)| corresponding to a representative data voltage value Vdrp, which is determined as either an average of the m data voltages Vdata that are to be written to the pixel circuits Pix(i,1) to Pix(i,m) connected to the corresponding threshold control line TCi or the data voltage that corresponds to the lowest luminance among the m data voltages Vdata. Specifically, for each threshold control line TCi (where i=1 to n), the representative data voltage value Vdrp is be determined for the data voltages to be written to the pixel circuits Pix(i,1) to Pix(i,m) that correspond to the threshold control line TCi, and the threshold control voltage Vtc(i) to be provided to the threshold control terminals TG of the drive transistors T1 in the corresponding circuits Pix(i,1) to Pix(i,m) is generated as expressed by a function Vtc(i,t) of time t given by the following equation using the determined representative data voltage value Vdrp.

$$Vtc(i,t)=VtcI+(Vdrp-|Vth(0)|-Vini)t/\{(Cst\cdot R\text{off})(Ct/Cb)\} \tag{18}$$

As can be seen from equation (18), when Ct>Cb, i.e., the gate insulating film capacitance Ct at the threshold control terminal is greater than the gate insulating film capacitance Cb at the main control terminal, decreasing the change amount (top/bottom range) of the threshold control voltage Vtc(i,t) still renders it possible to inhibit the fluctuation of the drive current I1 due to changes of the gate voltage Vg of the drive transistor T1.

Furthermore, the above representative data voltage value Vdrp may be replaced by a representative data voltage value Vdrp, which is determined as either an average of the n×m data voltages that are to be written to the n×m pixel circuits Pix(i,j) of the display portion 11*b* for each frame period or the data voltage that corresponds to the lowest luminance among the n×m data voltages Vdata. Alternatively, the representative data voltage value Vdrp for the n×m data voltage Vdata may be a predetermined value based on various display images. In either case, the same representative data voltage value Vdrp is determined for each threshold control line TCi, and therefore the display control circuit 20 provides the threshold control terminals TG of the drive transistors T1 in all pixel circuits Pix(1,1) to Pix(n,m) with threshold control voltages as given by the function Vtc(i,t) of time t defined by equation (18) using the same representative data voltage value Vdrp, i.e., the provided threshold control voltages are given by the same time function Vtc(i, t)=Vtc(t).

It should be noted that in the case where the threshold control voltages as given by the same time function Vtc(t) are provided to all pixel circuits Pix(1,1) to Pix(n,m), as described above, the n threshold control lines TC1 to TCn provided along the scanning signal lines G1 to Gn, as shown in FIG. 1, may be replaced by m threshold control lines TC1 to TCm provided along the data signal lines D1 to Dm. Moreover, in the case where the threshold control voltages as given by the same time function Vtc(t) is provided to all pixel circuits Pix(1,1) to Pix(n,m), as described above, the threshold control lines do not have to be provided in one-to-one correspondence with the scanning signal lines G1 to Gn or the data signal lines D1 to Dm, and therefore the number of threshold control lines may be less than the number of scanning signal lines G1 to Gn or the number of data signal lines D1 to Dm.

<1.6 Effects>

In the present embodiment as described above, in the pause drive mode, the threshold control voltage Vtc(i) is increased, thereby compensating for the decrease in the voltage that is being held by the holding capacitor Cst (or the change in the amount of stored charge) in each pixel circuit Pix(i,j), i.e., the decrease in the gate voltage Vg, which is caused due to a leakage current through the first initialization transistor T4 during the emission period (FIG. 9). Specifically, in each pixel circuit Pix(i,j), the change of the gate voltage Vg is compensated for by providing the threshold control terminal TG with the threshold control voltage Vtc(i), which causes a potential on the threshold control terminal TG to change in an opposite direction to a potential change at the main gate terminal (i.e., a change of the gate voltage Vg) due to a change of the voltage that is being held by the holding capacitor Cst during the emission period. Accordingly, the drive current is inhibited from increasing due to a decrease in the gate voltage Vg, whereby flickering can be prevented from occurring due to the luminance of the organic EL element OL changing in the refresh cycle Tref-PD. Thus, the pause drive mode renders it possible to display a satisfactory image without flickering being perceived while reducing power consumption.

2. Second Embodiment

<2.1 Overall Configuration and Overall Operation>

Figure 10:
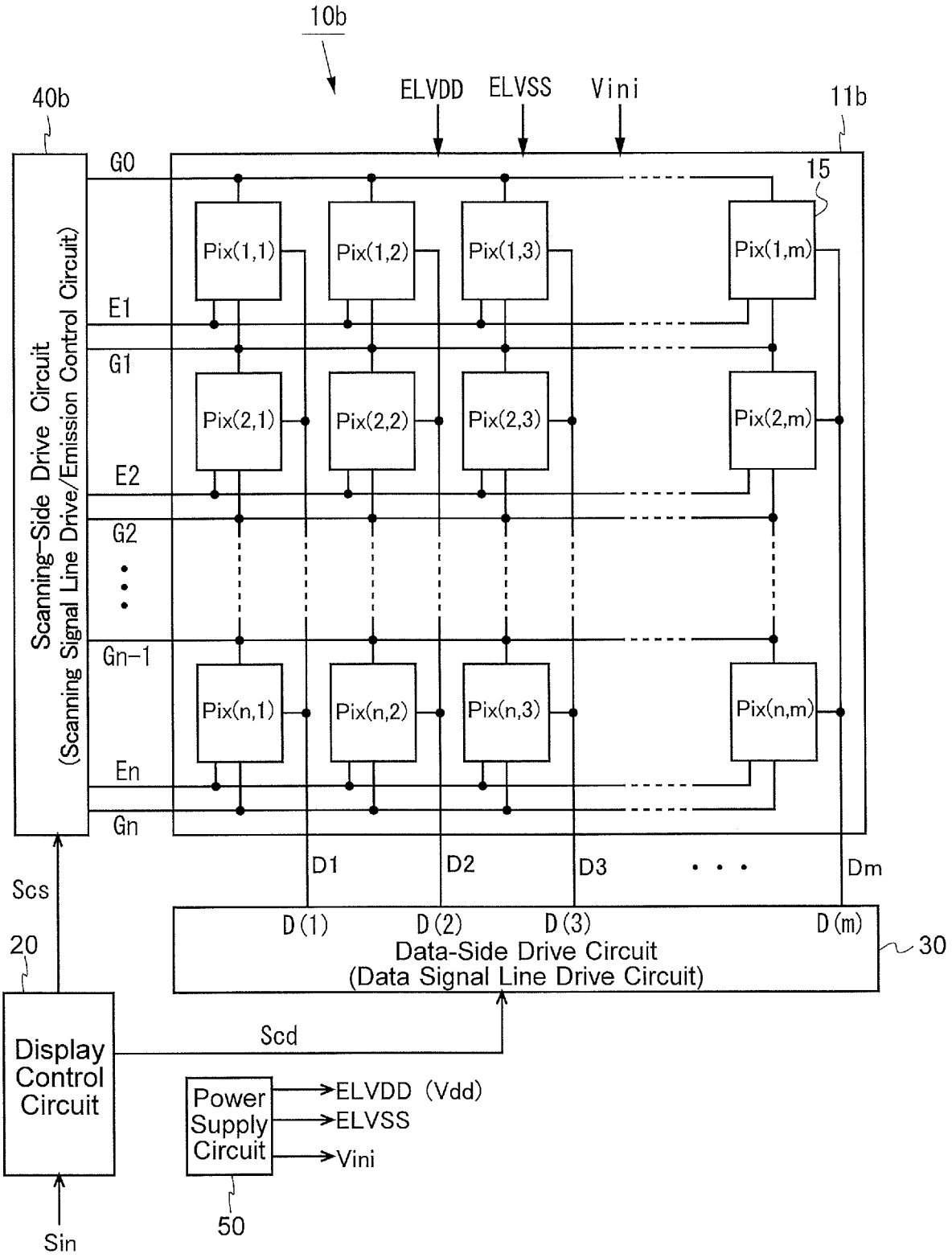
FIG. 10 is a block diagram illustrating an overall configuration of a display device according to a second embodiment.

FIG. 10 is a block diagram illustrating an overall configuration of an organic EL display device 10*b* according to a second embodiment. The display device 10*b* according to the present embodiment is also an organic EL display device which performs internal compensation. As in the first embodiment, the display device 10*b* includes a display portion 11*b*, a display control circuit 20, a data-side drive circuit 30, a scanning-side drive circuit 40*b*, and a power supply circuit 50. However, the present embodiment differs from the first embodiment in that the display portion 11*b* includes no threshold control lines TC1 to TCn. Correspondingly, in the present embodiment, the display control circuit 20 includes no threshold control circuit. Other features of the overall configuration in the present embodiment are the same as those in the first embodiment (see FIG. 1), and therefore the same or corresponding elements are denoted by the same reference characters and will not be elaborated upon.

As in the first embodiment, the display device 10*b* according to the present embodiment operates in two modes: normal drive mode and pause drive mode. Moreover, as in the first embodiment, in the normal drive mode, the refresh period (RF period) is repeated, as shown in FIG. 2, whereas in the pause drive mode, the refresh period (RF period) alternates with the non-refresh period (NRF period), as shown in FIG. 3. Note that in the present embodiment, the voltage Vtc for controlling the threshold Vth of the drive transistor is generated within each pixel circuit (details will be described later).

<2.2 Configuration of the Pixel Circuit>

Next, the configuration of the pixel circuit 15 in the present embodiment will be described with reference to FIG. 11.

Figure 11:
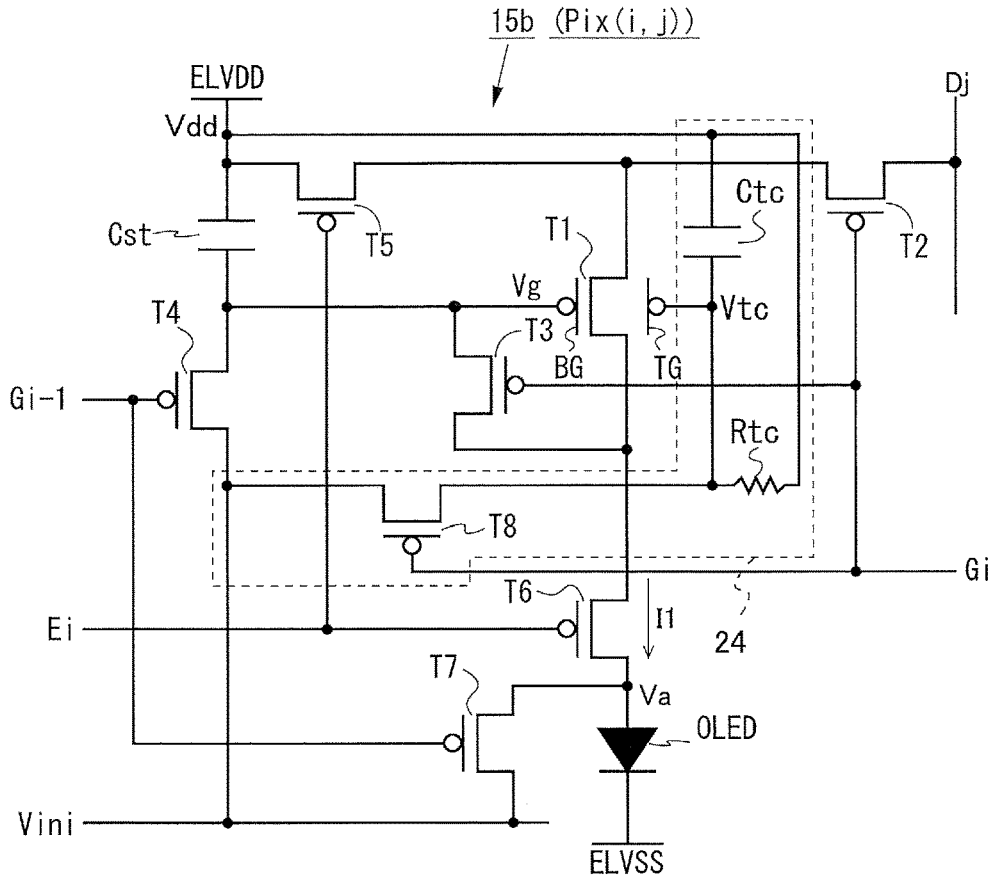
FIG. 11 is a circuit diagram illustrating a configuration of a pixel circuit in the second embodiment.
Figure 13:
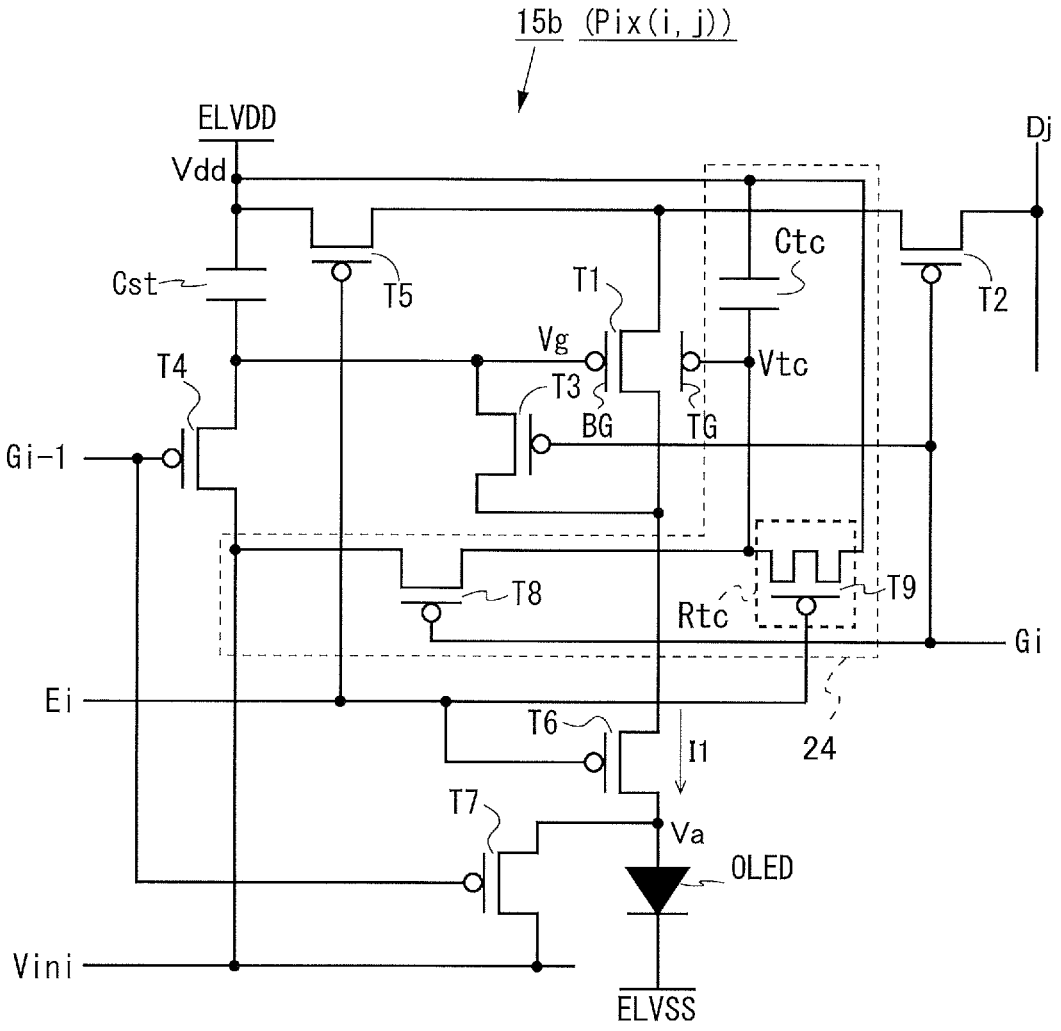
FIG. 13 is a circuit diagram illustrating another configuration example of the pixel circuit in the second embodiment.

FIG. 11 is a circuit diagram illustrating the configuration of a pixel circuit 15*b* in the present embodiment, more specifically, a pixel circuit 15*b* corresponding to the i'th scanning signal line Gi and the j'th data signal line Dj, i.e., the circuit diagram illustrates the configuration of the i'th-row, j'th-column pixel circuit Pix(i,j) (where 1≤i≤n, and 1≤j≤m). Similar to the pixel circuit 15 in the first embodiment (see FIG. 4), the pixel circuit 15*b* includes an organic EL element OL, which serves as a display element, a drive transistor T1, a write control transistor T2, a threshold compensation transistor T3, a first initialization transistor T4, a first emission control transistor T5, a second emission control transistor T6, a second initialization transistor T7, and a holding capacitor Cst, as shown in FIG. 11. In addition, the pixel circuit 15*b* further includes a threshold control transistor T8, a threshold control capacitor Ctc, and a threshold control resistance element Rtc. The threshold control resistance element Rtc has a resistance value sufficiently higher than an ON resistance of the threshold control transistor T8. Moreover, the resistance value is less than an OFF resistance of the threshold control transistor T8 (in the present embodiment, the resistance value is sufficiently lower than the OFF resistance of the threshold control transistor T8). Such a threshold control resistance element Rtc can be implemented, for example, using a conductor region of a semiconductor layer formed on a gate insulating film BGI, as shown in FIG. 5, or using a transistor. In the latter case, the threshold control resistance element Rtc can be implemented, for example, by connecting a corresponding emission control line Ei to a gate terminal of a P-channel transistor T9, as shown in FIG. 13, which has a narrow channel width W and a long channel length and hence has a higher-than-normal ON resistance.

It should be noted that in the pixel circuit 15*b*, the transistors T2 to T8, i.e., all the transistors excluding the drive transistor T1, function as switching elements. Moreover, as in the first embodiment, the drive transistor T1 is a double-gate P-channel transistor with a top gate electrode TG and a bottom gate electrode BG (see FIG. 5), the bottom gate electrode BG is used as a main gate terminal for controlling a current flowing through the drive transistor T1, and the top gate electrode TG is used as a threshold control terminal for controlling a threshold of the drive transistor T1.

The pixel circuit 15*b* is connected to a corresponding scanning signal line Gi, which is a scanning signal line corresponding thereto, a preceding scanning signal line Gi−1, which is a scanning signal line immediately preceding the corresponding scanning signal line Gi, a corresponding emission control line Ei, which is an emission control line corresponding to the pixel circuit 15*b*, a corresponding data signal line Dj, which is a data signal line corresponding to the pixel circuit 15*b*, an initialization voltage supply line Vini, a high-level power supply line ELVDD, and a low-level power supply line ELVSS. The pixel circuit 15*b* is the same as the pixel circuit 15 in the first embodiment in terms of the form of connections between the lines, including the above signal and power supply lines, and all elements excluding the threshold control transistor T8, the threshold control capacitor Ctc, and the threshold control resistance element Rtc (i.e., the organic EL element OL, the drive transistor T1, the write control transistor T2, the threshold compensation transistor T3, the first initialization transistor T4, the first emission control transistor T5, the second emission control transistor T6, the second initialization transistor T7, and the holding capacitor Cst), and also the form of connections between all the elements excluding the threshold control transistor T8, the threshold control capacitor Ctc, and the threshold control resistance element (see FIGS. 4 and 11).

In the present embodiment, unlike in the first embodiment, the pixel circuit 15*b* includes the threshold control transistor T8, the threshold control capacitor Ctc, and the threshold control resistance element Rtc, the threshold control terminal (top gate electrode) TG of the drive transistor T1 is connected to the high-level power supply line ELVDD via the threshold control capacitor Ctc, to the initialization voltage supply line Vini via the threshold control transistor T8, and to the high-level power supply line ELVDD via the threshold control resistance element Rtc, as shown in FIG. 11.

<2.3 Operation of the Pixel Circuit>

Figure 12:
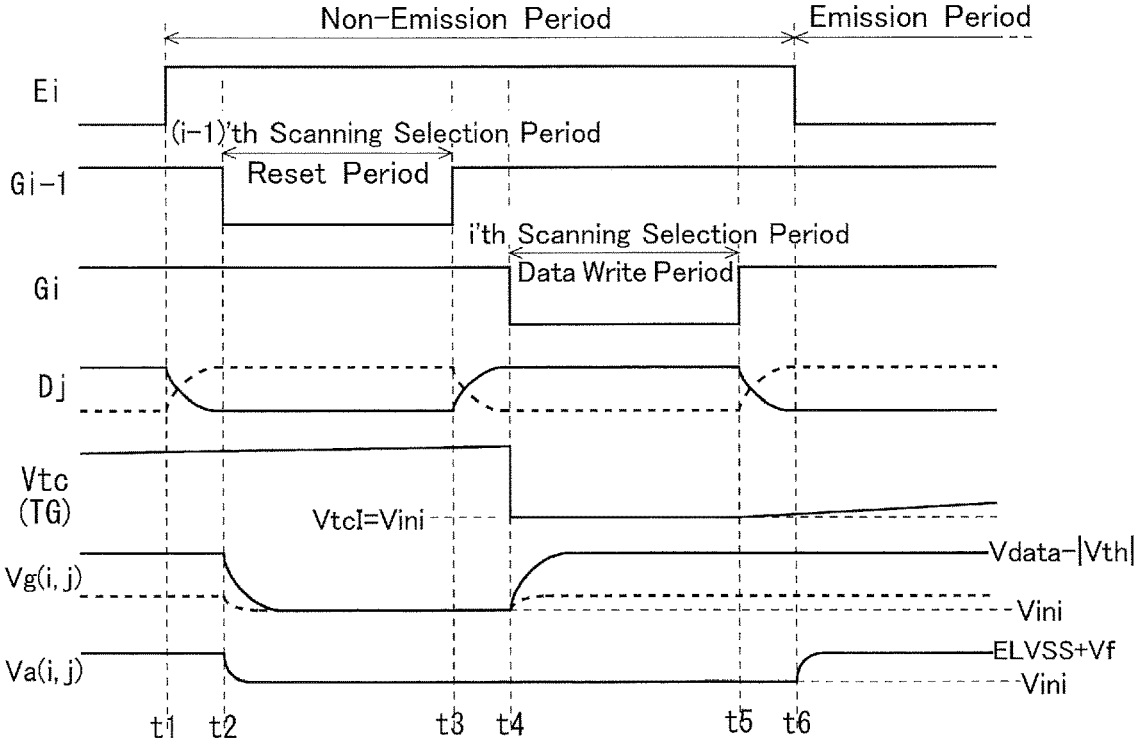
FIG. 12 is a signal waveform diagram for describing a driving of the display device according to the second embodiment.

FIG. 12 is a signal waveform diagram for describing an operation of the pixel circuit 15*b* in the present embodiment and showing changes in voltages during reset, data writing, and lighting operations of the pixel circuit 15*b* as configured above and shown in FIG. 11, i.e., the i'th-row, j'th-column pixel circuit Pix(i,j), the voltages including voltages on the respective signal lines (i.e., the corresponding emission control line Ei, the preceding scanning signal line Gi−1, the corresponding scanning signal line Gi, and the corresponding data signal line Dj, as well as the threshold control terminal TG), the voltage (gate voltage) Vg on the main gate terminal of the drive transistor T1, and the voltage (anode voltage) Va on the anode electrode of the organic EL element OL.

As can be appreciated by comparing the signal waveform diagram shown in FIG. 12 with the signal waveform diagram shown in FIG. 6, the signal lines (i.e., the corresponding emission control line Ei, the preceding scanning signal line Gi−1, the corresponding scanning signal line Gi, and the corresponding data signal line Dj) connected to the pixel circuit Pix(i,j) are driven in the same manner as in the first embodiment, and in the present embodiment, the pixel circuit Pix(i,j) performs the reset, data writing, and lighting operations in the same manner as in the first embodiment. However, in the present embodiment, the voltage on the threshold control terminal TG of the drive transistor T1 in each pixel circuit Pix(i,j) is not provided by the threshold control circuit in the display control circuit 20 via the corresponding threshold control line TCi, and the pixel circuit Pix(i,j) internally generates the voltage using the threshold control transistor T8, the threshold control capacitor Ctc, and the threshold control resistance element Rtc. Details thereof will be described below.

<2.4 Configuration and Operation for Threshold Control>

In the present embodiment, the voltage Vtc (referred to below as the "threshold control voltage") on the threshold control terminal TG of the drive transistor T1 in each pixel circuit Pix(i,j) changes as shown in FIG. 12. Specifically, the threshold control transistor T8 is connected at the gate terminal to the corresponding scanning signal line Gi, and therefore the threshold control transistor T8 transitions from an OFF state to an ON state at time t4, i.e., at the start of the data write period, which corresponds to the i'th scanning selection period, and maintains the ON state until the end of the data write period at time t5, as shown in FIG. 12. Accordingly, the threshold control voltage Vtc is decreased to the initialization voltage Vini at time t4 and kept at the initialization voltage until time t5. Thereafter, the threshold control transistor T8 transitions to an OFF state at the end of the data write period at time t5 and maintains the OFF state until the corresponding scanning signal line Gi is selected during the next RF period. While the threshold control transistor T8 is in the OFF state after the end of the data write period at time t5, the threshold control voltage Vtc changes as described below. In the following, the threshold control voltage Vtc is considered to be a function of time t and therefore represented by Vtc(t), and the end of the data write period at time t5 is represented by t=0.

When the threshold control transistor T8 is in an ON state, the threshold control capacitor Ctc is charged by the high-level power supply line ELVDD and the initialization voltage supply line Vini so as to hold a voltage Vdd-Vini. Thereafter, the threshold control transistor T8 transitions to an OFF state at the end of the data write period at time t5, and thereafter while the threshold control transistor T8 is in the OFF state, charge stored on the threshold control capacitor Ctc is released via the threshold control resistance element Rtc. Accordingly, the threshold control voltage Vtc(t) at this time can be expressed by the following equation.

$$Vtc(t)=(Vini-Vdd)\exp(-t/(Ctc\cdot Rtc))+Vdd \tag{19}$$

Here, assuming that t/(Ctc·Rtc) is sufficiently low, Vtc(t) as given by equation (19) is approximated by the following equation.

$$Vtc(t)=(Vini-Vdd)\{1-t/(Ctc\cdot Rtc)\}+Vdd$$

$$=Vini+(Vdd-Vini)t/(Ctc\cdot Rtc) \tag{20}$$

In the present embodiment, as in the first embodiment, the threshold control voltage Vtc is changed so as to inhibit the drive current I1 from increasing due to a decrease in the gate voltage Vg caused by a leakage current through the first initialization transistor T4 during the emission period. To this end, as can be appreciated by comparing equations (17) and (20) described earlier, in the present embodiment, given that Vtc(0)=Vini, the capacitance value of the threshold control capacitor Ctc (the capacitance value will also be denoted by the symbol "Ctc") and the resistance value of the threshold control resistance element Rtc (the resistance value will also be denoted by the symbol "Rtc") are set so as to satisfy the following equations:

$$(Vdd-Vini)/(Ctc\cdot Rtc)=(Vg(0)-Vini)/\{(Cst\cdot Roff)\cdot Ct/Cb\}$$

$$Ctc\cdot Rtc=(Vdd-Vini)(Cst\cdot Roff)(Ct/Cb)/(Vg(0)-Vini) \quad (21)$$

It should be noted that Vg(0) in equations (21) is given by equation (5) described earlier such that:

$$Vg(0)=V\text{data}-|Vth(0)|,$$

and therefore, when equations (21) are satisfied, the capacitance value Ctc and the resistance value Rtc depend on the data voltage Vdata that is to be written to the pixel circuit Pix(i,j). However, given this dependence, a representative data voltage value Vdrp may be determined in the same manner as in the first embodiment, and the capacitance value Ctc of the threshold control capacitor and the resistance value Rtc of the threshold control resistance element may be set in accordance with equation (21) using a gate voltage Vg(0)=Vdrp−|Vth(0)|, which corresponds to the determined representative data voltage value Vdrp. Note that the capacitance value Ctc and the resistance value Rtc are circuit constants, and therefore the representative data voltage value Vdrp determined in the present embodiment is a fixed value.

Furthermore, as can be appreciated from equations (21), when Ct<Cb, i.e., the gate insulating film capacitance Ct at the threshold control terminal is less than the gate insulating film capacitance Cb at the main control terminal, setting Ctc·Rtc lower than Cst·Roff still renders it possible to achieve the desired effect of inhibiting the fluctuation of the drive current I1 due to changes of the gate voltage Vg of the drive transistor T1.

<2.5 Effects>

In the present embodiment as described above, in each pixel circuit Pix(i,j), the threshold control capacitor Ctc, the threshold control transistor T8, and the threshold control resistance element Rtc constitute a threshold control circuit 24 for generating the threshold control voltage Vtc (see FIG. 11), and the threshold control voltage Vtc is used to control the threshold Vth of the drive transistor T1. Accordingly, even when the gate voltage Vg of the drive transistor T1 is decreased due to a leakage current through the first initialization transistor T4, the drive current I1 is inhibited from increasing. Thus, effects similar to those achieved by the first embodiment can be achieved without providing the threshold control lines TC1 to TCn in the display portion and also without generating the threshold control voltages Vtc(1) to Vtc(n) to be provided to the pixel circuits Pix(i,j) via the threshold control lines TC1 to TCn (see FIG. 9).

3. Variants

The disclosure is not limited to the embodiments, and various modifications can also be made without departing from the scope of the disclosure.

For example, in the first embodiment, in the normal drive mode, the threshold control voltage Vtc(i) is fixed to VtcI but may be changed as in the pause drive mode (see FIGS. 3 and 9).

Furthermore, in the first embodiment, in the pause drive mode, for each row of pixel circuits Pix(i,1) to P(i,m), the threshold control voltage Vtc(i), which is changed at times suitable for the row, is provided to the threshold control terminals TG of the drive transistors T1 in the pixel circuits Pix(i,1) to P(i,m) via the threshold control lines TC1 to TCn (see FIG. 3). However, in the pause drive mode, in which the NRF period (non-refresh period) lasts sufficiently long, the threshold control signals TC(1) to TC(n) that are to be applied to the threshold control lines TC1 to TCn, respectively, may be generated as voltages Vts of the same value (i.e., the voltages are given by the same time function). Moreover, in this case, the n threshold control lines TC1 to TCn may be replaced by one common threshold control line, such that the threshold control voltages Vtc as given by the same time function are provided to the threshold control terminals TG of the drive transistors T1 in all pixel circuits Pix(1,1) to P(n,m).

In the first and second embodiments, the top gate electrode TG of the drive transistor T1 is used as the threshold control terminal, and the bottom gate electrode BG is used as the main gate terminal (i.e., the control terminal for controlling the current flowing through the drive transistor T1) (FIGS. 4 and 11), but instead of this, the top gate electrode TG may be used as the main gate terminal, and the bottom gate electrode BG may be used as the threshold control terminal.

In the pause drive mode of the first embodiment and the second embodiment, the threshold control voltage Vtc(i) or Vtc provided to the threshold control terminal TG of the drive transistor T1 in each pixel circuit Pix(i,j) changes periodically in the refresh cycle that corresponds to intervals of data voltage writing to the pixel circuit Pix(i,j). Specifically, as shown in figures such as FIGS. 3 and 9, the threshold control voltage gradually increases over time from the initial threshold control voltage VtcI during one refresh cycle and returns to the initial threshold control voltage VtcI at the time of each data voltage writing (note that in the second embodiment, VtcI=Vini). More specifically, in the pause drive mode of the first embodiment, the time of returning to the initial threshold control voltage VtcI (or Vini) coincides with the start of the reset period (the (i−1)'th scanning selection period) for the pixel circuit Pix(i,j) at time t2, as shown in FIG. 6, and in the second embodiment, the time of returning coincides with the start of the data write period (the i'th scanning selection period) for the pixel circuit Pix(i,j) at time t4, as shown in FIG. 12. However, the time at which the threshold control voltage Vct(t) returns to the initial threshold control voltage VtcI (or Vini) is not limited to the timing as shown in FIGS. 6 and 12, so long as the returning occurs during the non-emission period (preferably, during the period from time t1 to time t4 but before the start of the data write period at time t4). Accordingly, for example, in the second embodiment, the gate terminal of the threshold control transistor T8 in the pixel circuit Pix(i,j) is connected to the corresponding scanning signal line Gi, as shown in FIG. 11, but instead of this, the gate terminal may be connected to the preceding scanning signal line Gi−1. Note that in the pause drive mode, in which the NRF period (non-refresh period) lasts sufficiently long, the time at which the threshold control voltage Vct(t) is set to return to the initial threshold control voltage VtcI (or Vini) during the non-emission period does not significantly affect the effect of compensating for the decrease in the voltage (gate voltage Vg) being held by the holding capacitor Cst due to a leakage current through the first initialization transistor T4 or other transistors.

The first and second embodiments use the pixel circuits 15 and 15*b* for internal compensation, as shown in FIGS. 4 and 11, respectively, but the configurations of these pixel circuits are not limiting. Specifically, the disclosure can be applied to any configuration so long as the drive transistor controls the drive current for a current-driven display element such as the organic EL element in accordance with the voltage being held by the holding capacitor, and the voltage being held by the holding capacitor can change due to a leakage current within the pixel circuit during the emission period. Moreover, in the first and second embodiments, the drive transistors T1 used in the pixel circuits 15 and 15*b* are P-channel transistors (see FIGS. 4 and 11), but the disclosure can be applied to cases where N-channel transistors (e.g., N-channel thin-film transistors with channel layers formed of In—Ga—Zn—O (indium gallium zinc oxide), which is an oxide semiconductor mainly composed of indium (In), gallium (Ga), zinc (Zn), and oxygen (O)) are used as drive transistors T1 and/or other elements, and the application of the disclosure to such cases renders it possible to achieve the same effect (as the effect of providing satisfactory display without flickering even when pause drive is performed).

In the first and second embodiment, the equation for the decrease in the gate voltage Vg (i.e., the voltage that is being held by the holding capacitor Cst), which causes flickering in a display image, is formulated considering only the leakage current through the first initialization transistor T4 as the cause of the decrease, and the equation for the threshold control voltage Vtc for compensating for the decrease is derived from the formulated equation. In the case where some leakage current in another path (e.g., a leakage current in a path from the main gate terminal of the drive transistor T1 through the threshold compensation transistor T3, the emission control transistor T6, and the organic EL element OL to the low-level power supply line ELVSS) is not negligible as a cause of the decrease in the gate voltage Vg, the equation for the threshold control voltage Vtc for compensating for the decrease can also be derived by formulating the equation for the decrease in the gate voltage Vg in accordance with a similar approach to the above.

While the embodiments and the variants thereof have been described above taking as an example the organic EL display device, the disclosure is not limited to the organic EL display device and can be applied to any display devices, so long as the display devices use current-driven display elements. Display elements that can be used are those for which luminance, transmittance, etc., are controlled by currents, and in addition to organic EL elements, that is, organic light-emitting diodes (OLEDs), examples of the display elements include inorganic light-emitting diodes and quantum-dot light-emitting diodes (QLEDs).

DESCRIPTION OF THE REFERENCE CHARACTERS

10, 10*b* organic EL display device
11, 11*b* display portion
15, 15*b* pixel circuit
Pix(i,j) pixel circuit (i=1 to n; j=1 to m)
20 display control circuit
22, 24 threshold control circuit
30 data-side drive circuit (data signal line drive circuit)
40 scanning-side drive circuit (scanning signal line drive circuit/emission control circuit)
40*b* scanning-side drive circuit (scanning signal line drive circuit/emission control circuit)
Gi scanning signal line (i=1 to n)
Ei emission control line (i=1 to n)
TCi threshold control line (i=1 to n)
Dj data signal line (j=1 to m)
Vini initialization voltage supply line; initialization voltage
ELVDD high-level power supply line (first power supply line); high-level power supply voltage
ELVSS low-level power supply line (second power supply line); low-level power supply voltage
OL organic EL element (display element)
Cst holding capacitor
Ctc threshold control capacitor
Rtc threshold control resistance element
T1 drive transistor
T2 write control transistor
T3 threshold compensation transistor
T4 first initialization transistor (initialization switching element)
T5 first emission control transistor
T6 second emission control transistor
T7 second initialization transistor
T8 threshold control transistor (threshold control switching element)
BG main gate terminal; bottom gate electrode (first gate electrode)
TG threshold control terminal; top gate electrode (second gate electrode)
BGI gate insulating film (first insulating film)
TGI gate insulating film (second insulating film)
Va anode voltage
Vg gate voltage
Vtc threshold control voltage
Tref-PD refresh cycle in pause drive mode

The invention claimed is:

1. A display device having a plurality of data signal lines, a plurality of scanning signal lines crossing the data signal lines, and a plurality of pixel circuits arranged in a matrix along the data signal lines and the scanning signal lines, the display device comprising:

first and second power supply lines;

a data signal line drive circuit configured to drive the data signal lines;

a scanning signal line drive circuit configured to selectively drive the scanning signal lines; and a threshold control circuit provided outside the pixel circuits or inside each of the pixel circuits, wherein each pixel circuit corresponds to one of the scanning signal lines and one of the data signal lines, each pixel circuit includes a current-driven display element, a holding capacitor, and a drive transistor, the drive transistor includes a main control terminal for controlling a current flowing through the drive transistor and a threshold control terminal for controlling a threshold of the drive transistor, the main control terminal of the drive transistor is connected to the first power supply line via the holding capacitor, each pixel circuit is configured such that:

when the corresponding scanning signal line is selected, a voltage on the corresponding data signal line is written to the holding capacitor as a data voltage; and during an emission period for the display element, the drive transistor controls a drive current for the display element flowing in a path from the first power supply line through the drive transistor and the display element to the second power supply line, in accordance with a voltage being held by the holding capacitor, and for each pixel circuit, the threshold control circuit provides the threshold control terminal with a threshold control voltage during the emission period for the display element, the threshold control voltage causing the threshold of the drive transistor to change so as to compensate for a change of the voltage being held by the holding capacitor due to a leakage current within the each pixel circuit;

wherein the display device operates in a normal drive mode and a pause drive mode such that in the normal drive mode, the scanning signal line drive circuit and the data signal line drive circuit are actuated so as to repeat a refresh period, during which the scanning signal lines are sequentially selected to write data voltages to the pixel circuits, and in the pause drive mode, the scanning signal line drive circuit and the data signal line drive circuit are actuated so as to cause the refresh period to alternate with a non-refresh period, during which the scanning signal lines are not selected so as to stop the data voltages from being written to the pixel circuits, in the normal drive mode, the threshold control voltage provided by the threshold control circuit to the threshold control terminal of the drive transistor in each pixel circuit is a constant voltage, and in the pause drive mode, the threshold control voltage provided by the threshold control circuit to the threshold control terminal of the drive transistor in each pixel circuit is a voltage that causes the threshold of the drive transistor to change so as to compensate for the change of the voltage being held by the holding capacitor due to the leakage current within the each pixel circuit during the emission period for the display element in the each pixel circuit.

2. The display device according to claim 1, further comprising an initialization voltage supply line, wherein each pixel circuit further includes an initialization switching element, the main control terminal of the drive transistor is connected to the initialization voltage supply line via the initialization switching element, and the leakage current causing the voltage being held by the holding capacitor to change during the emission period for the display element includes a leakage current through the initialization switching element in an OFF state.

3. The display device according to claim 2, further comprising a plurality of threshold control lines corresponding to the respective scanning signal lines, wherein each of the threshold control lines is connected to the threshold control terminal of the drive transistor in a pixel circuit connected to a scanning signal line corresponding to the each of the threshold control lines, and the threshold control circuit generates threshold control voltages to be provided to the threshold control terminals of the drive transistors in the pixel circuits, outside the pixel circuits, and supplies the threshold control voltages to the pixel circuits via the threshold control lines.

4. The display device according to claim 3, wherein the threshold control circuit generates a common threshold control voltage for the threshold control lines and supplies the common threshold control voltage to the pixel circuits via the threshold control lines.

5. The display device according to claim 3, wherein the threshold control circuit generates a threshold control voltage to be supplied through each threshold control line, such that the threshold control voltage changes periodically in a refresh cycle equivalent to a time interval for writing a data voltage to a pixel circuit connected to a scanning signal line corresponding to the each threshold control line, and assuming that a time of each occurrence of data voltage writing to the pixel circuit is time t=0, the threshold control voltage changes in the refresh cycle in accordance with a function Vtc(t) of time t as given by the following equation:

$$Vtc(t)=VtcI+(Vdrp-|Vth(0)|-Vini)t/\{(Cst\cdot Roff)(Ct/Cb)\},$$

where VtcI is a voltage on the threshold control terminal at the writing of the data voltage, Vdrp is a value equivalent to a representative value of the data voltages to be written to the pixel circuits connected to the scanning signal line corresponding to the each threshold control line, Vth(0) is a threshold of the drive transistor at the writing of the data voltage, Vini is a voltage on the initialization voltage supply line, Cst is a capacitance value of the holding capacitor, Roff is a resistance value of the initialization switching element in an OFF state, Ct is a value of a gate insulating film capacitance at the threshold control terminal of the drive transistor, and Cb is a value of a gate insulating film capacitance at the main control terminal of the drive transistor.

6. The display device according to claim 5, wherein the representative value is determined so as to be the same for all the threshold control lines.

7. The display device according to claim 5, wherein the representative value is a value determined for each threshold control line and corresponding to an average of data voltages to be written to pixel circuits connected to the scanning signal line corresponding to the each threshold control line.

8. The display device according to claim 2, further comprising a plurality of threshold control lines provided along the respective data signal lines, wherein each of the threshold control lines is connected to the threshold control terminal of the drive transistor in a pixel circuit connected to a data signal line corresponding to the each of the threshold control lines, and the threshold control circuit generates a common threshold control voltage to be provided to the threshold control terminals of the drive transistors in the pixel circuits, outside the pixel circuits, and provides the common threshold control voltage to the pixel circuits via the threshold control lines.

9. The display device according to claim 1, wherein in the pause drive mode, the threshold control voltage provided by the threshold control circuit to the threshold control terminal in each pixel circuit is a voltage that causes a potential on the threshold control terminal to change in an opposite direction to a potential change at the main control terminal due to the change of the voltage being held by the holding capacitor during the emission period for the display element.

10. The display device according to claim 1, wherein the drive transistor has a first gate electrode serving as the main control terminal, a second gate electrode serving as the threshold control terminal, and first and second insulating films, the first gate electrode is positioned opposite to a surface of a semiconductor layer acting as a channel region of the drive transistor, with the first insulating film being positioned between the first gate electrode and the surface, and the second gate electrode is positioned opposite to another surface of the semiconductor layer acting as the channel region, with the second insulating film being positioned between the second gate electrode and the another surface.

11. The display device according to claim 10, wherein the second gate electrode and the semiconductor layer with the second insulating film positioned therebetween form a larger capacitance than the first gate electrode and the semiconductor layer with the first insulating film positioned therebetween.

12. A method for driving a display device having a plurality of data signal lines, a plurality of scanning signal lines crossing the data signal lines, first and second power supply lines, and a plurality of pixel circuits arranged in a matrix along the data signal lines and the scanning signal lines, the method comprising:

driving the data signal lines;

selectively driving the scanning signal lines; and controlling a threshold of drive transistors included in the pixel circuits, wherein each pixel circuit corresponds to one of the scanning signal lines and one of the data signal lines, each pixel circuit includes a current-driven display element, a holding capacitor, and the drive transistor, the drive transistor includes a main control terminal for controlling a current flowing through the drive transistor and a threshold control terminal for controlling the threshold of the drive transistor, the main control terminal of the drive transistor is connected to the first power supply line via the holding capacitor, each pixel circuit is configured such that:

when the corresponding scanning signal line is selected, a voltage on the corresponding data signal line is written to the holding capacitor as a data voltage; and during an emission period for the display element, the drive transistor controls a drive current for the display element flowing in a path from the first power supply line through the drive transistor and the display element to the second power supply line, in accordance with a voltage being held by the holding capacitor, and in controlling the threshold of the drive transistors, for each pixel circuit, the threshold control terminal is provided with a threshold control voltage during the emission period for the display element, the threshold control voltage causing the threshold of the drive transistor to change so as to compensate for a change of the voltage being held by the holding capacitor due to a leakage current within the each pixel circuit;

wherein the display device operates in a normal drive mode and a pause drive mode such that in the normal drive mode, selectively driving the scanning signal lines and driving the data signal lines are performed so as to repeat a display image refresh, whereby the scanning signal lines are sequentially selected to write data voltages to the pixel circuits, and in the pause drive mode, selectively driving the scanning signal lines and driving the data signal lines are performed so as to cause a refresh period for the display image refresh to alternate with a non-refresh period, during which the scanning signal lines are not selected to stop the display image refresh, and controlling the threshold of the drive transistors includes:

in the normal drive mode, providing the threshold control voltage having a constant value to the threshold control terminal of the drive transistor in each pixel circuit, and in the pause drive mode, providing the threshold control voltage to the threshold control terminal of the drive transistor in each pixel circuit so as to cause the threshold of the drive transistor to change and thereby compensate for the change of the voltage being held by the holding capacitor due to the leakage current within the each pixel circuit during the emission period for the display element in the each pixel circuit.

13. The method according to claim 12, wherein the display device further includes an initialization voltage supply line, each pixel circuit further includes an initialization switching element, the main control terminal of the drive transistor is connected to the initialization voltage supply line via the initialization switching element, and the leakage current causing the voltage being held by the holding capacitor to change during the emission period for the display element includes a leakage current through the initialization switching element in an OFF state.

14. The method according to claim 13, wherein the display device further includes a plurality of threshold control lines corresponding to the respective scanning signal lines, each of the threshold control lines is connected to the threshold control terminal of the drive transistor in a pixel circuit connected to the corresponding scanning signal line, and in controlling the threshold of the drive transistors, threshold control voltages to be provided to the threshold control terminals of the drive transistors in the pixel circuits are generated outside the pixel circuits and supplied to the pixel circuits via the threshold control lines.

* * * * *